US008083084B2

(12) United States Patent
Vovan

(10) Patent No.: US 8,083,084 B2
(45) Date of Patent: Dec. 27, 2011

(54) INVERTIBLE TRAY

(75) Inventor: Terry Vovan, Upland, CA (US)

(73) Assignee: PWP Industries, Inc., Vernon, CA (US)

( * ) Notice: Subject to any disclaimer, the term of this patent is extended or adjusted under 35 U.S.C. 154(b) by 954 days.

(21) Appl. No.: 11/899,576

(22) Filed: Sep. 6, 2007

(65) Prior Publication Data

US 2009/0065514 A1 Mar. 12, 2009

(51) Int. Cl.
*B65D 21/032* (2006.01)

(52) U.S. Cl. ..... 220/4.24; 220/4.21; 206/508

(58) Field of Classification Search ..... 220/4.21, 220/4.24, 574, 788, 784, 794, 781, 780; 206/508
See application file for complete search history.

(56) References Cited

U.S. PATENT DOCUMENTS

| | | | | |
|---|---|---|---|---|
| 2,024,995 | A * | 12/1935 | Guy | 220/574 |
| 2,260,651 | A | 10/1941 | Annen | |
| 2,720,332 | A | 10/1955 | Holt | |
| 2,738,915 | A | 3/1956 | St. Clair | |
| 2,798,631 | A | 7/1957 | Engel | |
| 2,986,300 | A | 5/1961 | Parrish | |
| 2,999,611 | A | 9/1961 | Paulson | |
| 3,007,602 | A | 11/1961 | Frank | |
| 3,049,259 | A | 8/1962 | Mazzi et al. | |
| 3,459,356 | A | 8/1969 | Sparks | |
| 3,520,440 | A | 7/1970 | Kinnavy et al. | |
| 3,565,146 | A | 2/1971 | Arnolds | |
| 3,572,413 | A | 3/1971 | Livingstone | |
| 3,620,403 | A | 11/1971 | Rump | |
| 3,664,538 | A | 5/1972 | Fioretti | |
| 3,902,540 | A | 9/1975 | Commisso | |
| 3,933,295 | A | 1/1976 | Congleton | |
| 3,938,726 | A | 2/1976 | Holden, Jr. et al. | |
| 3,938,727 | A | 2/1976 | Andersson | |
| 3,982,651 | A | 9/1976 | Braun et al. | |
| 4,014,450 | A | 3/1977 | Girotti et al. | |
| 4,114,668 | A | 9/1978 | Hickey | |

(Continued)

FOREIGN PATENT DOCUMENTS

| | | |
|---|---|---|
| BE | 740346 | 10/1969 |

(Continued)

OTHER PUBLICATIONS

English translation of Belgian Patent No. 740,346 dated Oct. 16, 1969 (8 pages).

*Primary Examiner* — Stephen Castellano
(74) *Attorney, Agent, or Firm* — Nixon Peabody LLP

(57) ABSTRACT

A container (10) with lower and upper parts of formed plastic sheeting, is constructed of two identical elements (12, 14) that can close and latch to each other to form a closed container by turning a second of the elements upside down to make it the upper element, and pressing it down against the lower first element. The lower element includes a base wall (20) which is the bottommost wall and which has a vertical axis (22), upstanding side walls (24), and a flange (30) extending radially away from the top of the side walls. Along a left half (34) of the lower element, the flange forms an upward projection(s) (42), and along the right half (36) of the lower element the flange forms an upwardly-opening groove (44). Each projection and groove extends in a zig-zag line along the flange.

8 Claims, 29 Drawing Sheets

U.S. PATENT DOCUMENTS

| | | | | |
|---|---|---|---|---|
| 4,124,141 | A | 11/1978 | Armentrout et al. | |
| 4,149,578 | A | 4/1979 | Hickey | |
| 4,171,062 | A | 10/1979 | Allen et al. | |
| 4,180,179 | A | 12/1979 | Hoenig et al. | |
| 4,195,746 | A | 4/1980 | Cottrell | |
| 4,201,301 | A | 5/1980 | Aggio | |
| 4,201,311 | A | 5/1980 | Underwood | |
| 4,216,763 | A | 8/1980 | Miklas | |
| 4,238,047 | A | 12/1980 | Helms et al. | |
| 4,266,689 | A | 5/1981 | Asher | |
| 4,294,371 | A | 10/1981 | Davis | |
| 4,307,817 | A | 12/1981 | Cotroneo | |
| 4,334,631 | A | 6/1982 | Ballester | |
| 4,350,263 | A | 9/1982 | Hoffman | |
| 4,360,118 | A | 11/1982 | Stern | |
| 4,362,265 | A | 12/1982 | Williams | |
| 4,378,895 | A | 4/1983 | Woinarski | |
| 4,388,998 | A | 6/1983 | Underwood et al. | 220/307 |
| 4,394,922 | A | 7/1983 | Wimmer | 215/300 |
| 4,397,404 | A | 8/1983 | Blanchette | 220/306 |
| 4,446,986 | A | 5/1984 | Bowen et al. | 220/307 |
| 4,457,432 | A | 7/1984 | Solheim | 206/503 |
| 4,458,825 | A | 7/1984 | Holota | 220/307 |
| 4,487,326 | A | 12/1984 | Uhlig | 215/307 |
| 4,520,943 | A | 6/1985 | Nielsen | 220/281 |
| 4,524,882 | A | 6/1985 | Buc | 220/306 |
| 4,555,043 | A | 11/1985 | Bernhardt | 220/306 |
| 4,664,254 | A | 5/1987 | Sitwell et al. | 206/1.7 |
| 4,741,434 | A | 5/1988 | Liebman | 206/38 |
| 4,765,500 | A | 8/1988 | Ingram | 220/4 |
| 4,811,550 | A | 3/1989 | Hautemont | 53/478 |
| 4,819,824 | A | 4/1989 | Longbottom et al. | 220/266 |
| 4,838,444 | A | 6/1989 | Bitel | 220/4 |
| 4,854,472 | A | 8/1989 | Semersky | 220/306 |
| 4,856,707 | A | 8/1989 | Lorenz | |
| 4,878,595 | A | 11/1989 | Uhlig | 220/306 |
| 4,890,740 | A | 1/1990 | Tabler | 206/509 |
| 4,930,636 | A | 6/1990 | Meadows | 206/503 |
| 4,971,774 | A | 11/1990 | Schwanke et al. | 422/310 |
| 4,974,738 | A | 12/1990 | Kidd et al. | |
| 5,036,980 | A | 8/1991 | Vigue et al. | 206/515 |
| 5,042,674 | A | 8/1991 | Ramsay et al. | 220/4.24 |
| 5,060,851 | A | 10/1991 | Lorenz | |
| 5,069,354 | A | 12/1991 | Tannenbaum | 220/4.22 |
| 5,097,977 | A | 3/1992 | Straub | 220/307 |
| 5,152,710 | A * | 10/1992 | Montgomery | 446/75 |
| 5,161,711 | A | 11/1992 | Picozza et al. | 220/282 |
| 5,170,905 | A | 12/1992 | Luch | 220/276 |
| 5,181,626 | A | 1/1993 | Daenen et al. | 220/282 |
| D339,741 | S | 9/1993 | Lorenz | |
| 5,265,749 | A | 11/1993 | Zutler | 220/4.24 |
| 5,273,174 | A | 12/1993 | Fisher | |
| 5,303,839 | A | 4/1994 | Blumenschein | 220/306 |
| 5,310,070 | A | 5/1994 | Haas et al. | 220/4.24 |
| 5,332,114 | A | 7/1994 | Sano et al. | |
| 5,356,023 | A | 10/1994 | Krupa | 220/4.24 |
| 5,377,860 | A | 1/1995 | Littlejohn et al. | 220/306 |
| 5,379,934 | A | 1/1995 | Lorenz | |
| 5,388,714 | A | 2/1995 | Zutler | 220/4.24 |
| 5,390,807 | A | 2/1995 | Galaburda | 220/4.24 |
| 5,437,386 | A | 8/1995 | Von Holdt | 220/306 |
| 5,437,388 | A | 8/1995 | Bartelt et al. | |
| 5,605,231 | A | 2/1997 | Borsboom et al. | 206/551 |
| 5,634,559 | A | 6/1997 | Foos et al. | 206/518 |
| 5,666,875 | A | 9/1997 | Wener | 99/422 |
| 5,785,203 | A | 7/1998 | Arshinoff et al. | 220/783 |
| 5,875,918 | A | 3/1999 | Sheffler | 220/783 |
| 5,979,687 | A | 11/1999 | Hayes et al. | |
| 5,992,679 | A | 11/1999 | Porchia et al. | 220/782 |
| 6,021,917 | A | 2/2000 | Lovell et al. | 220/782 |
| 6,029,803 | A | 2/2000 | Ovadia et al. | |
| 6,250,494 | B1 | 6/2001 | Diamond | 220/783 |
| 6,260,723 | B1 | 7/2001 | Bergholtz | 215/344 |
| 6,343,707 | B2 * | 2/2002 | Cheng | 220/4.24 |
| 6,491,185 | B1 | 12/2002 | Azzarello et al. | 220/783 |
| 6,886,704 | B2 | 5/2005 | Hayes et al. | |
| 6,923,338 | B2 | 8/2005 | Dees et al. | |
| 7,032,773 | B2 | 4/2006 | Dees et al. | |
| 2002/0175164 | A1 | 11/2002 | Dees et al. | |
| 2003/0057207 | A1 | 3/2003 | Wong | |
| 2005/0230389 | A1 | 10/2005 | Hayes | |
| 2006/0159807 | A1 | 7/2006 | Hayes et al. | |

FOREIGN PATENT DOCUMENTS

| | | |
|---|---|---|
| DE | 2349382 | 4/1975 |
| JP | 48-7205 | 2/1973 |
| JP | 51-81203 | 6/1976 |
| JP | 58-3456 | 1/1983 |
| JP | 59-11852 | 4/1984 |
| JP | 63-34069 | 3/1988 |
| JP | 63-62315 | 4/1988 |
| JP | 64-20462 | 2/1989 |
| JP | 2269665 | 11/1990 |
| JP | 8053148 | 2/1996 |
| JP | 11059711 | 3/1999 |
| JP | 20012405 | 1/2001 |
| JP | 2002166951 | 6/2002 |

* cited by examiner

INVERTIBLE TRAY

BACKGROUND OF THE INVENTION

Food is often packaged in a container of plastic sheeting deformed by heat, vacuum etc., the container including a lower container element that forms a cavity that can hold food, and a lid or cover element that covers the lower element. Two stacks of container elements are provided for a clerk at a workstation in a store. The clerk takes a lower element and loads food into it, and then takes a lid element and closes and latches it to the lower element. It would be desirable if the number of different container elements that must be manufactured and stacked were at a minimum, such as a single container element construction. However, the container elements should be constructed so they stack closely on one another during storage, so they latch and seal well to one another when the container is closed, and so a plurality of containers that each has been loaded with food can be securely stacked on one another.

SUMMARY OF THE INVENTION

In accordance with one embodiment of the present invention, container elements of identical construction are provided, where a second of the elements can be closed, latched and sealed to a first one, where the container elements can be closely stacked for storage, and where a plurality of containers that are each formed of a pair of the identical elements can be securely stacked on one another. The single type of element has a base wall that is lowermost for a lower element and that has a vertical axis. The lower element also has upstanding side walls, and has a flange that extends radially outward from the top of the side walls. The flange has a deformation line that forms a projection(s) and a groove along different flange sections.

Along a left half of the lower element, there is an upward projection, and along the right half of the lower element there is an upwardly-opening groove. When the upper element is laid on the identical lower element in the proper upside-down orientation, the upward projection in the left side of the lower element projects into a correspond downwardly-opening groove of the upper element, and the upwardly-opening groove in the right side of the lower element receives a downward projection of the upper element.

Each flange deformation line that forms a projection and a corresponding groove, can extend in a zig-zag path instead of a straight line, with at least five zigs and zags along each element half. The zig-zag line results in resistance to accidental opening of the container.

The base wall in the left half of the lower element has at least one downward projection. The base wall in the right half of the element has at least one large downward protuberance with a smaller upward recess therein that (when the element is turned upside-down) closely receives the downward projection of the left half of another element. This helps in secure stacking of food-loaded containers.

Towers that project up from the base wall (or project down when the element is turned upside down) to support one base wall on another, are constructed so some have undercut recesses and others have enlarged ends that fit into the recesses.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
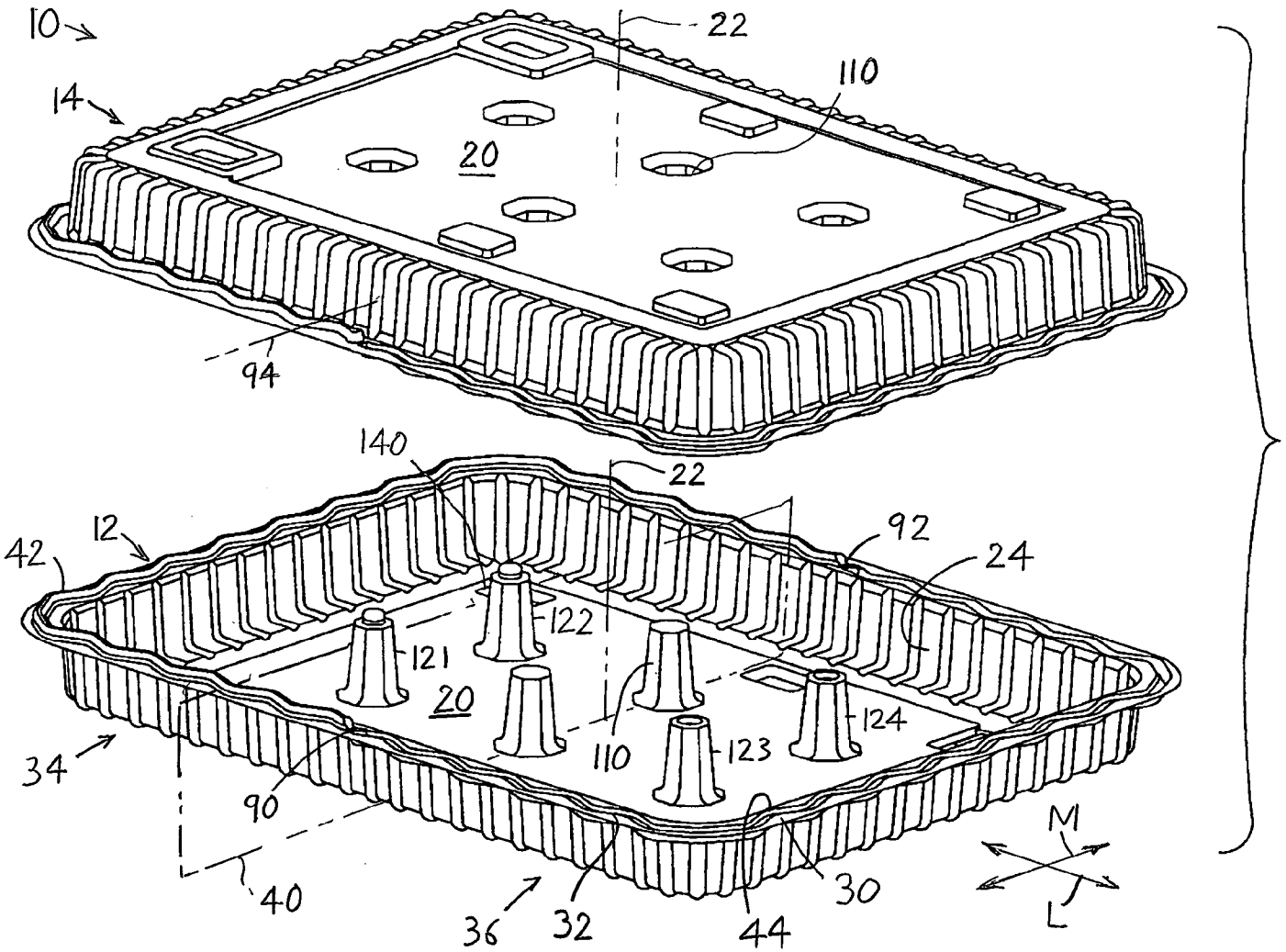
FIG. 1 is an exploded isometric view of a container of the present invention.

FIG. 1 shows a container apparatus, or container 10 of the invention, which includes first and second, or lower and upper, identical container elements 12, 14. Each element has a base wall or base 20, which is the bottommost wall for the lower element 12 and the topmost wall for the other element 14, with an axis 22 extending through the base walls. The lower element has upstanding side walls 24 that extend from the periphery of the base, and has a flange 30 that extends radially outward (i.e. away from the axis 22) from the top of the side walls. A zig-zag flange line 32 extends along the flange. The identical upper element has corresponding side walls and a flange.

Figure 3:
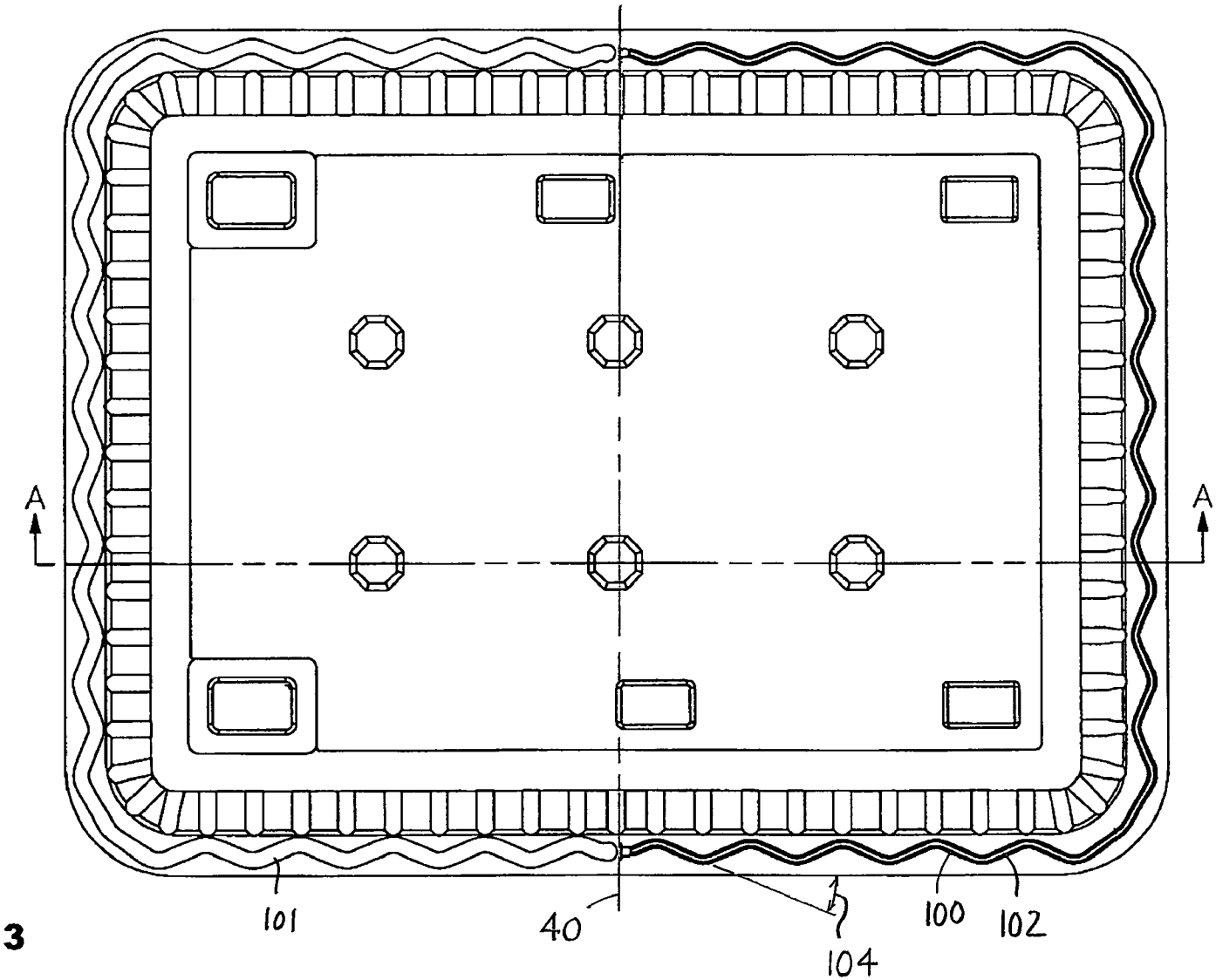
FIG. 3 is a bottom view of the container of FIG. 2.
Figure 4:
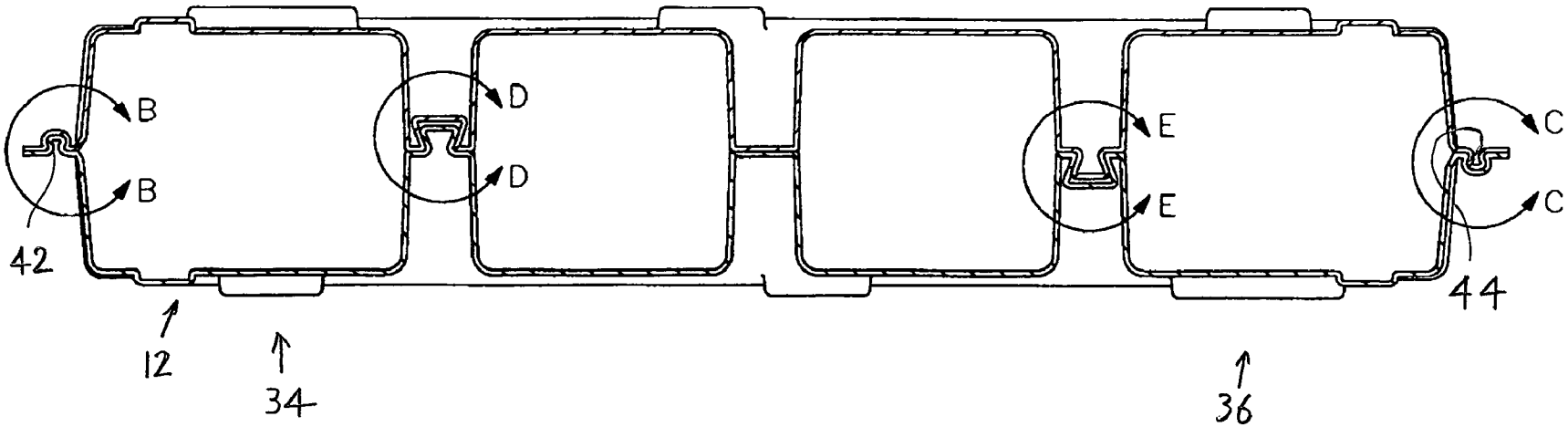
FIG. 4 is a sectional view taken on line A-A of FIG. 3.

Each container element such as the first one 12, has laterally L spaced left and right halves 34, 36 of equal lateral lengths, that lie on opposite sides of an imaginary vertical plane 40 that extends through the axis 22. Each flange is deformed along the flange line 32, by forming a projection in one surface of the flange that results in a groove in the opposite surface. FIG. 3 shows the top of a closed container, and FIG. 4 shows a sectional view of the closed container, showing that the left half 34 of the lower element 12 forms an upward projection 42 and the right half 36 of the lower element forms an upwardly-opening groove 44.

Figure 4B:
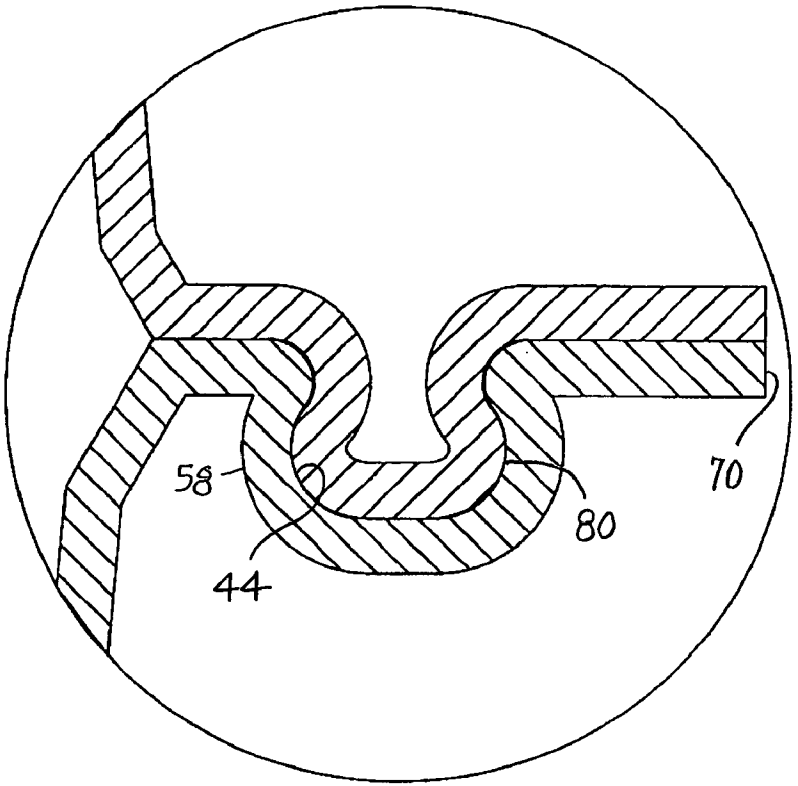
FIG. 4B is an enlarged view of area C-C of FIG. 4.
Figure 4A:
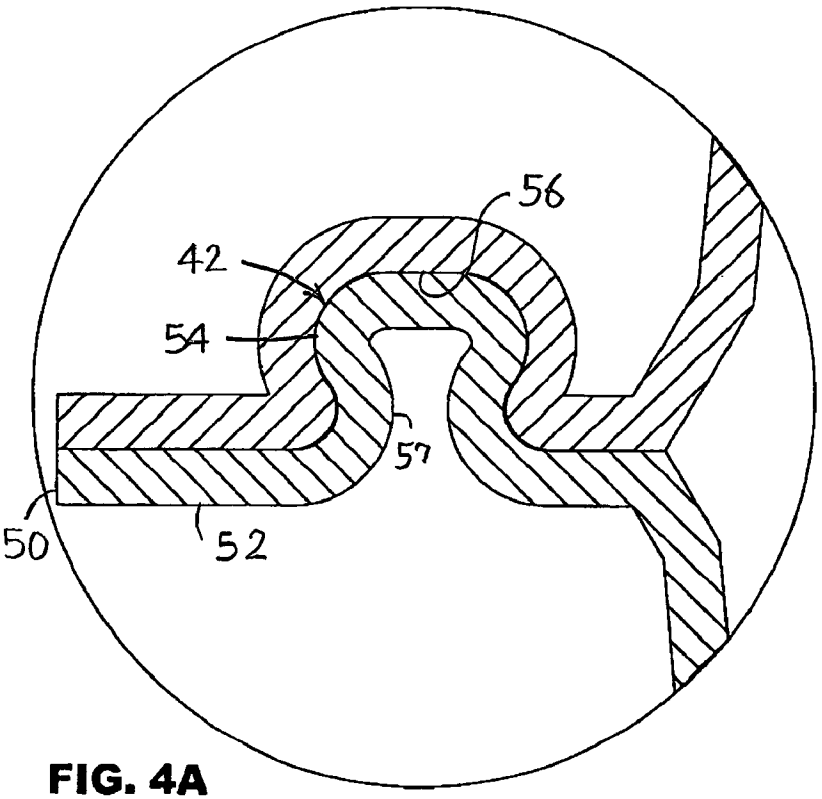
FIG. 4A is an enlarged view of area B-B of FIG. 4.

FIG. 4A shows that the flange portion 50 of the left half of the first, or lower container element has a flat portion 52 and forms the upward projection 42 with an enlarged top 54 that is received in a downwardly-opening groove 56 in the flange of the second or upper container element. FIG. 4B shows that the flange portion 70 of the right half of the lower container element forms the undercut groove 44. A downward projection 80 in the upper containment element lies in the groove 44. The projections 42, 80 that lie in the corresponding grooves 56, 44 hold, or latch, the upper and lower container elements together. The projections 42, 80 of FIGS. 4A and 4B are identical, and the grooves 56 and 44 of FIGS. 4A and 4B are identical. Applicant notes that since the container elements are formed of plastic sheeting, each upward projection such as 42 in FIG. 4A leaves a blind passage 57 and each upwardly-opening groove such as 44 in FIG. 4B leaves a downward jut 58. However, the passage 57 and jut 58 do not serve any separate function. FIG. 4 shows that the two container elements 12, 14 are identical, and are latched together by orienting the two container elements so a projection in the flange enters a corresponding groove.

As indicated in FIG. 1 the two container elements 12, 14 are identical. The upward projection 42 extends around half of the container from point 90 to point 92 that both lie on the vertical plane 40, at longitudinally M opposite sides of the lower container element. The upwardly-opening groove 44 extends around the other half of the container between the points 90, 92. The identical upper container element 14 has been turned 180° about a longitudinal axis 94 that lies in the plane 40. Although the projections and grooves extend along flange sections 30A, 30B that each occupies the entire length of each half-flange, or flange portion, it is possible to use shorter projections and grooves, as long as the projections and the grooves in one container element, are complementary. That is, shorter corresponding parts can be used as long as each length of projection or a projection part such as 100 in FIG. 3, and a corresponding length of groove, or groove or recess part such as 101, lie equally spaced from the vertical plane 40 and lie on directly opposite sides of the vertical plane, that is, the two lengths lie along a common laterally extending line that is normal to the imaginary plane 40.

Figure 2:
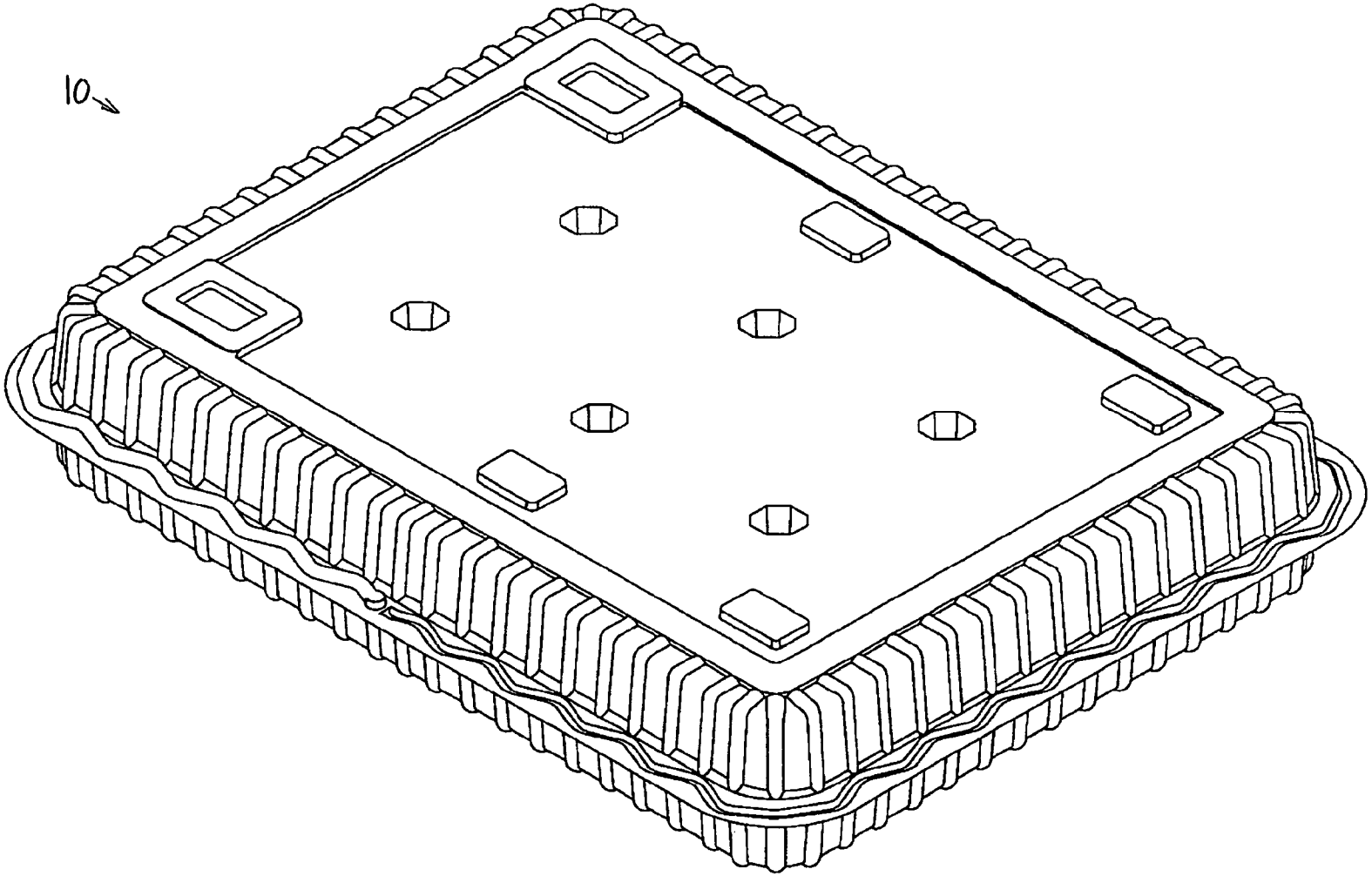
FIG. 2 is an isometric view of the container of FIG. 1, but with the two container elements closed on each other.

The zig-zag flange line 32 (FIG. 1) along which the upward projection 42 and upwardly-opening groove 44 extend, is provided to reduce the likelihood that the closed container of FIG. 2 will be accidently opened. FIG. 3 shows that each zig 100 and zag 102 extends at an angle 104 of about 20° to the length of flange at that location. An angle 104 of more than 10° and no more than 45° is preferred to avoid accidental opening. Even if a pull-up force is applied parallel to one zig line 100, such a force will be considerably angled from the adjacent zag line 102 and the zag line will resist opening by such a force that is angled from its direction of elongation.

FIG. 1 shows that the lower element 12 has vertically elongated upstanding towers 110 that extend up from the lowermost base wall 20. The upper element 14 has corresponding downward extending towers. The tips of corresponding towers rest on one another. As a result, if two or more closed containers lie on one another in a stack, as shown at 120 in FIG. 9, the towers transmit downward forces applied to an upper base wall 20 down through the stack. This is especially important when the containers contain food of considerable weight.

Figure 4D:
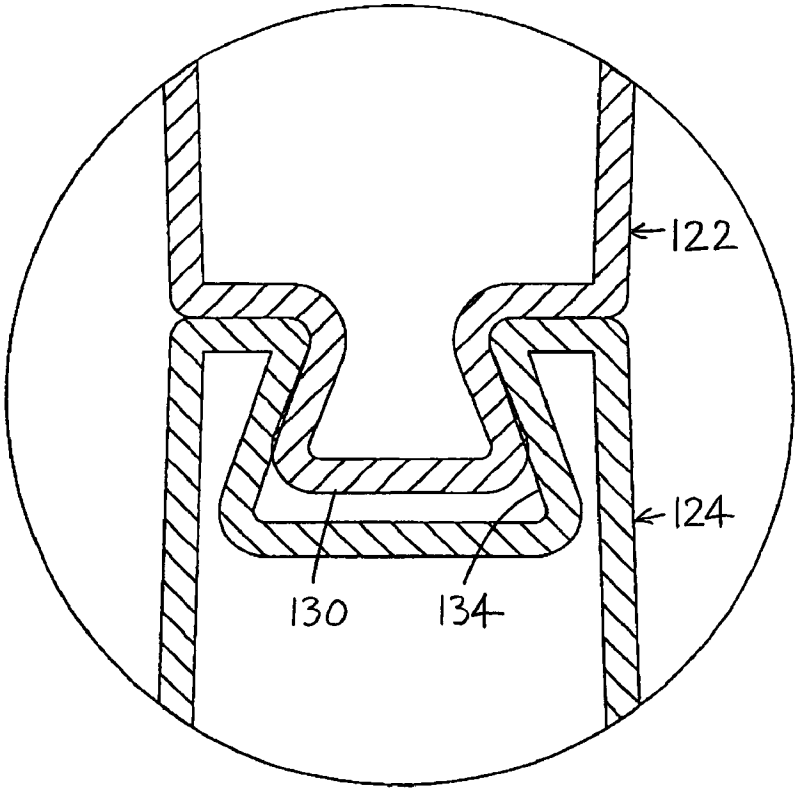
FIG. 4D is an enlarged view of area E-E of FIG. 4.
Figure 4C:
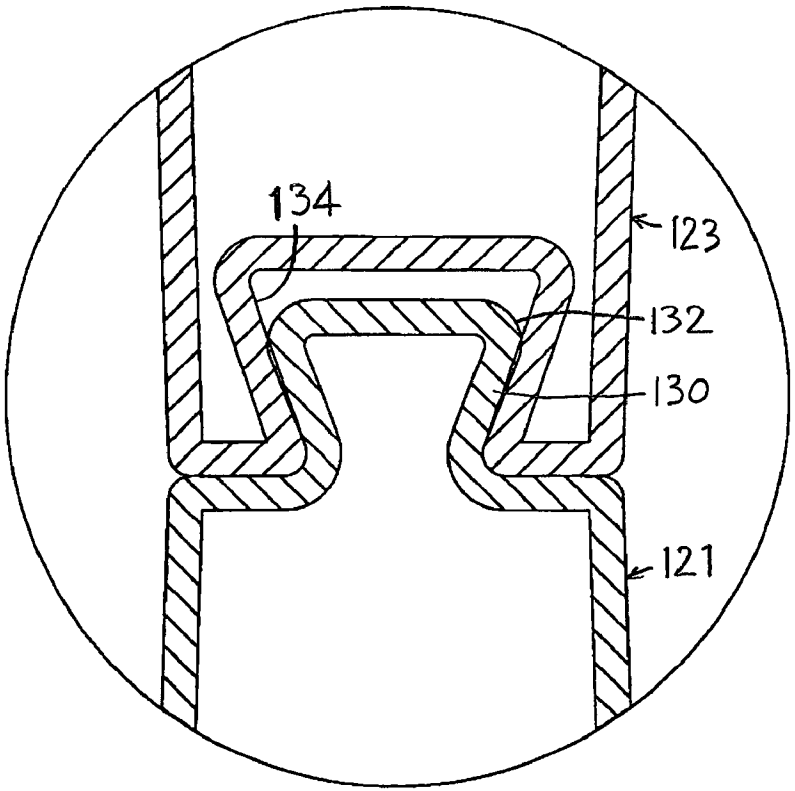
FIG. 4C is an enlarged view of area D-D of FIG. 4.
Figure 6:
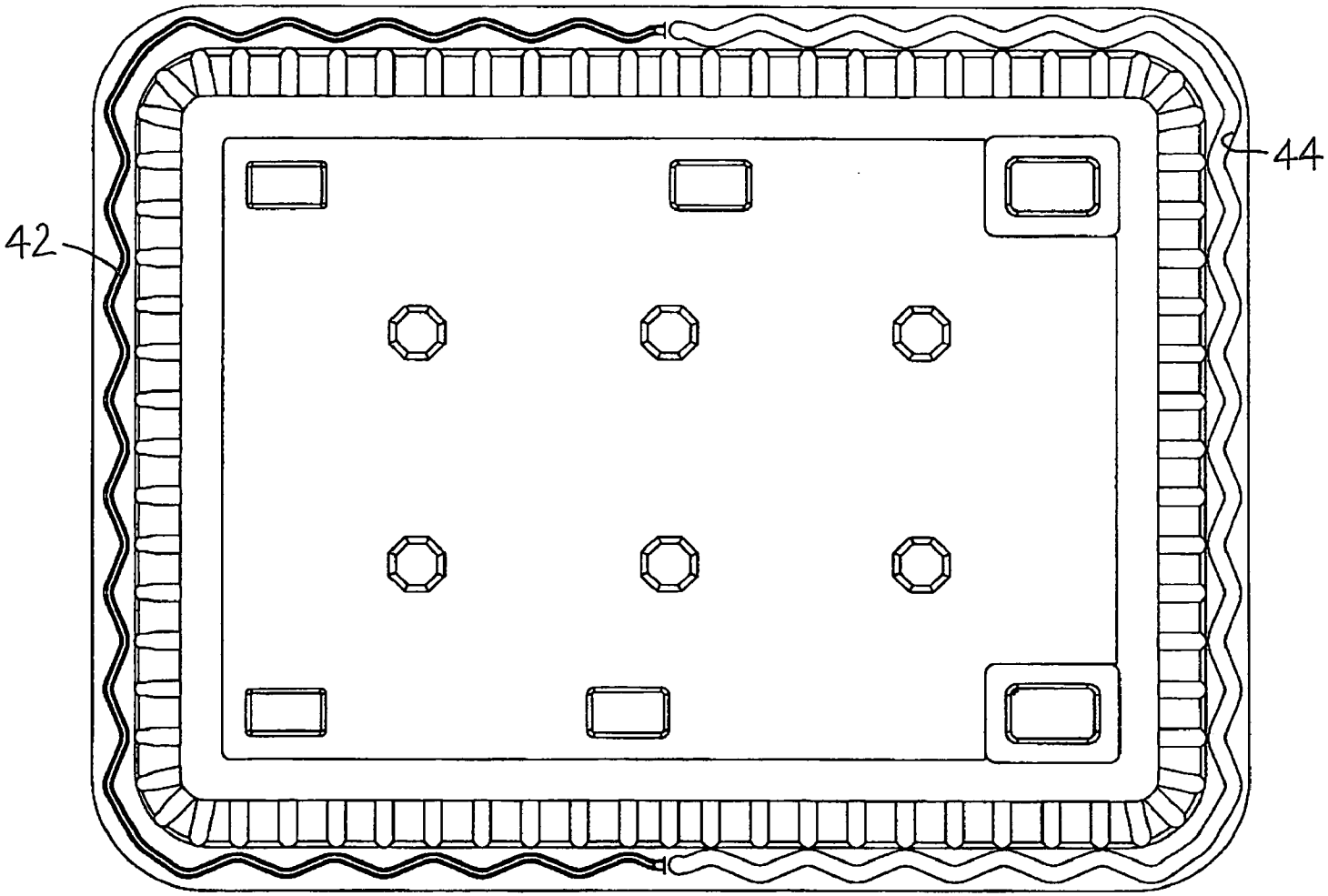
FIG. 6 is a bottom view of the container of FIG. 3.
Figure 7:
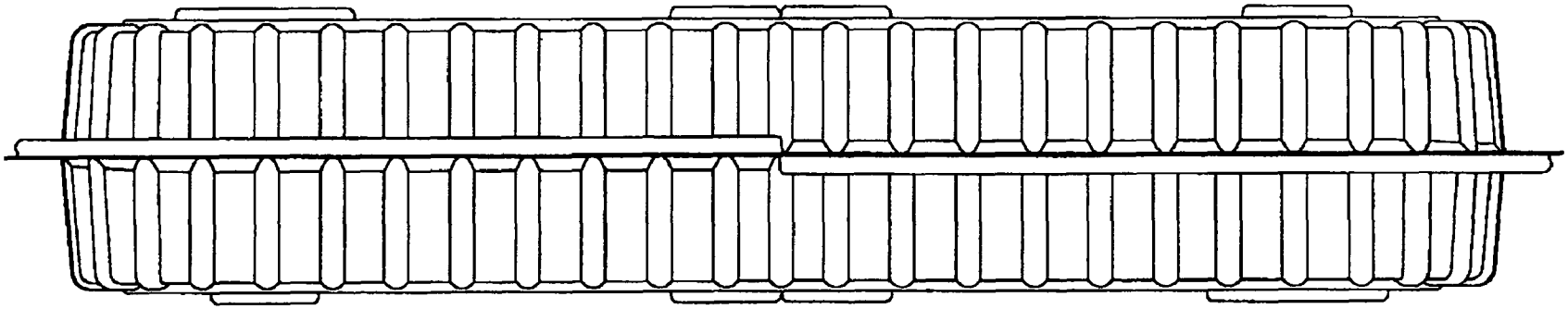
FIG. 7 is a front elevation view of the container as shown in FIG. 6.
Figure 8:
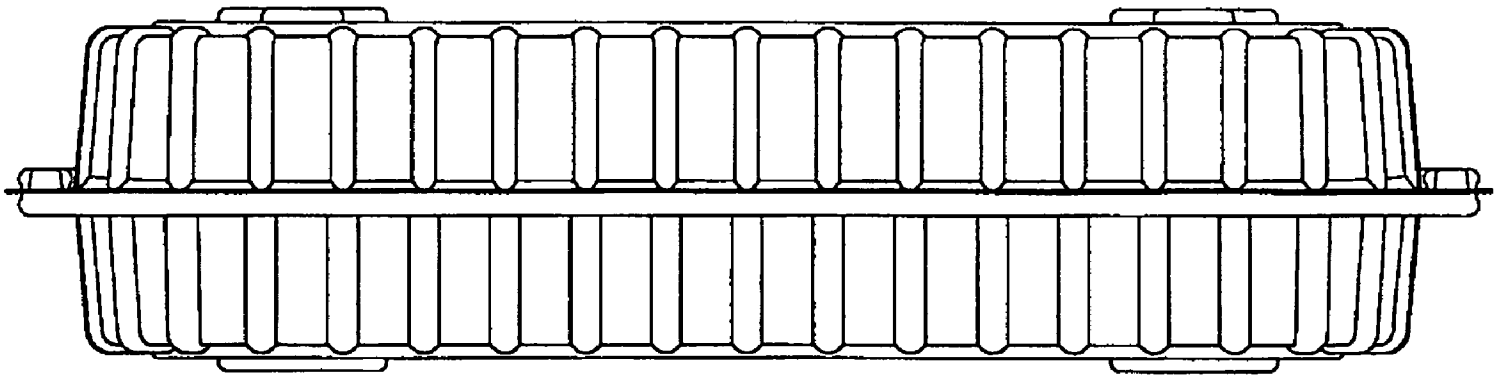
FIG. 8 is a right side elevation view of the container as shown in FIG. 6.

The towers (FIG. 1) are vertically elongated and of small diameters, so they do not occupy much space that otherwise would be occupied by food. When the container is closed, it is possible for the bottom of a downward tower to slide past the top of an upward tower, which could cause a stack of containers to fall apart. To prevent this, applicant latches together the adjacent tips of four of the six towers shown in FIG. 1. These four towers 121-124 are arranged with two of them 121, 122 having projections, and the other two 123, 124 having recesses. As shown in FIGS. 4C and 4D, each projection 130 at the tip of one tower such as 121, has an enlarged top 132 that fits into an undercut recess 134 in the tip of a corresponding tower 123 of an identical container element.

Figure 9:
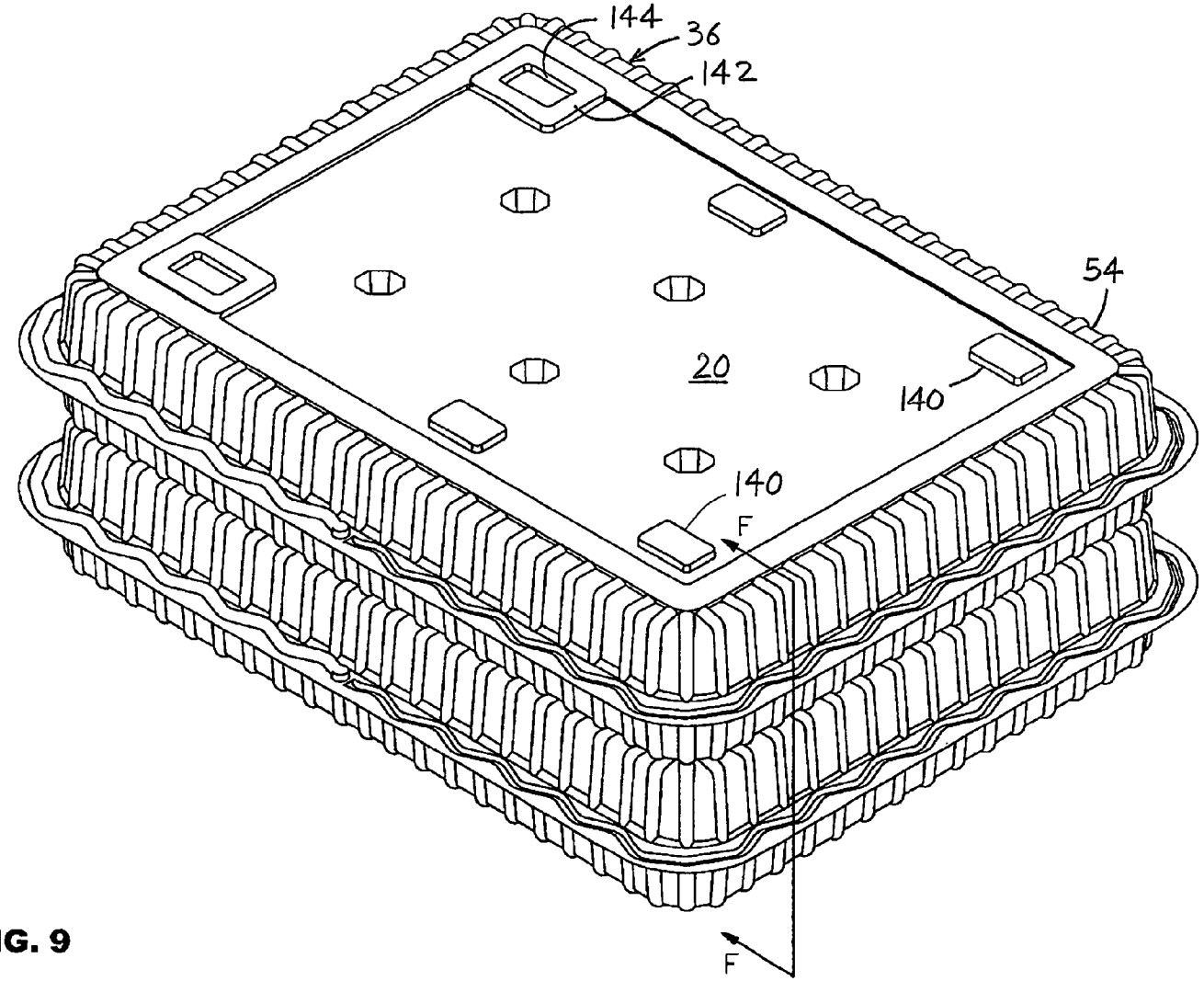
FIG. 9 is an isometric view of a pair of stacked containers of the type illustrated in FIG. 2.
Figure 10:
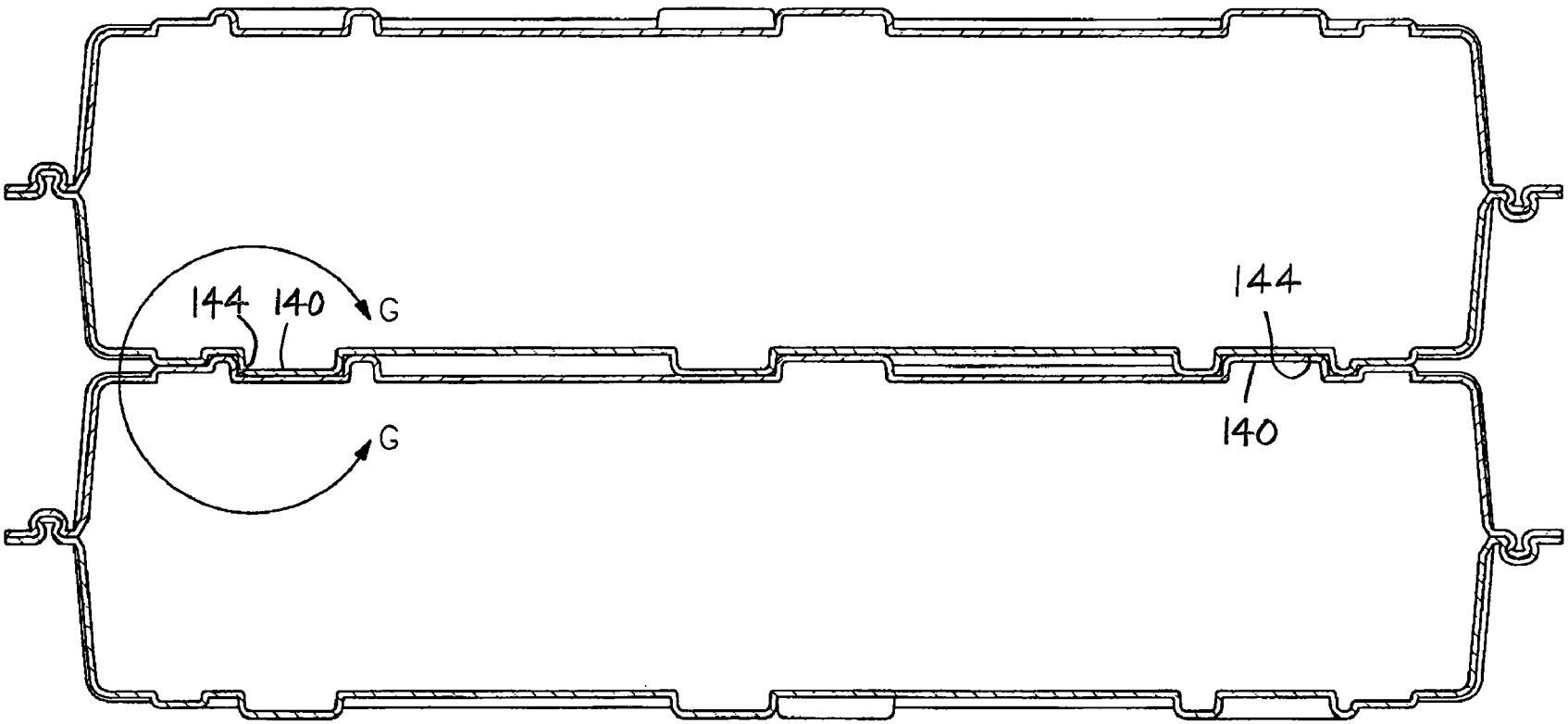
FIG. 10 is a sectional view taken on line F-F of FIG. 9.
Figure 10A:
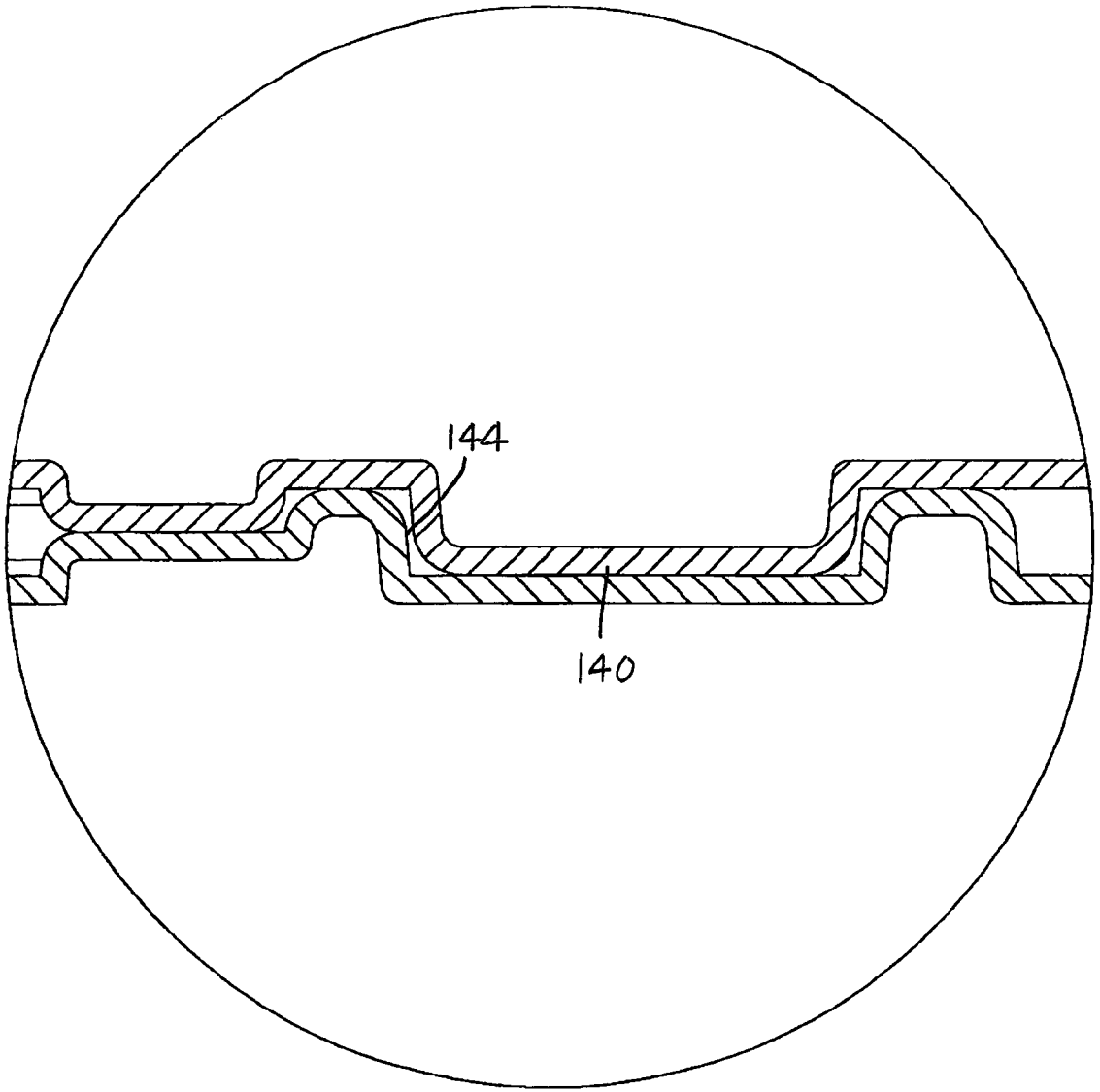
FIG. 10A is an enlarged view of area G-G of FIG. 10.

FIG. 9 shows that the base wall 20 of the upper container element has a pair of projections 140 in the left half 54 (that would be shown in the left half of the figure if the container element were turned upside-down so the base wall 20 were lowermost). The right half 36 of the element has a pair of large protuberances 142 with recesses 144 that can closely receive one of the projections 140 of the left side (of another identical container element). When two or more closed containers are stacked on one another, the pair of projections 140 of the lower container fit into the pair of recesses 144 at the bottom of the upper container. Similarly, the projections of the upper container fit into the recesses of the lower container. In this way, each container is prevented from sliding away from a position centered on the next lower container. FIG. 10 shows that at the right side of the figure, a projection 140 of the lower container lies closely in a recess 144 of the upper container, and shows that at the left side of the figure a projection 140 of the lower container projects up into the recess 144 of the upper container. FIG. 10A shows that each projection 140 fits closely in a corresponding recess 144.

In a container of the construction of FIGS. 1-10 that applicant designed, the container was rectangular with an inside of 12 inches by 14 inches. This would be considered a large container, and the side walls were corrugated.

Figure 11:
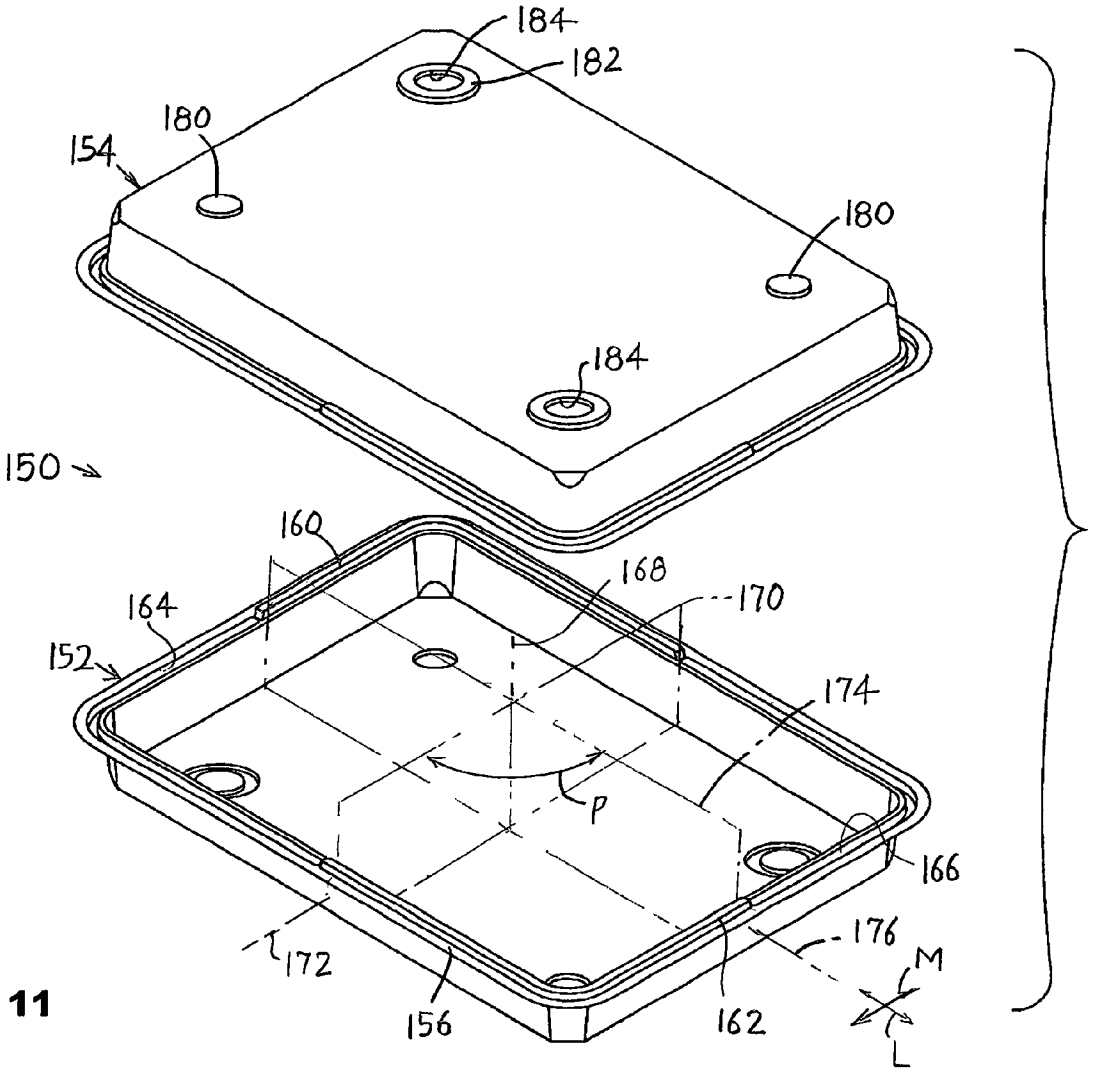
FIG. 11 is an isometric view of two container elements of a container of another embodiment of the invention.
Figure 12:
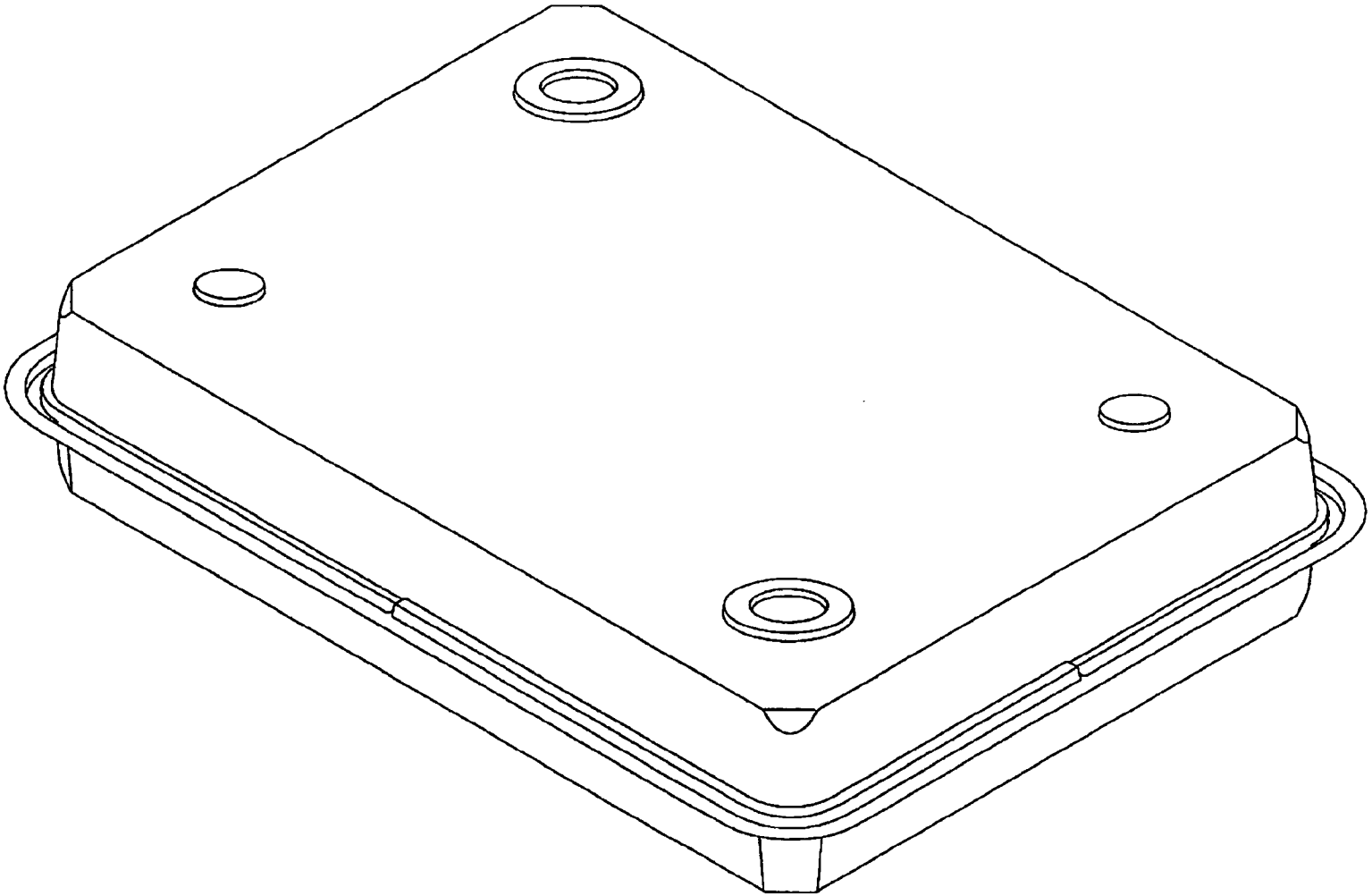
FIG. 12 is an isometric view of a closed container formed by the container elements of FIG. 11.
Figure 13:
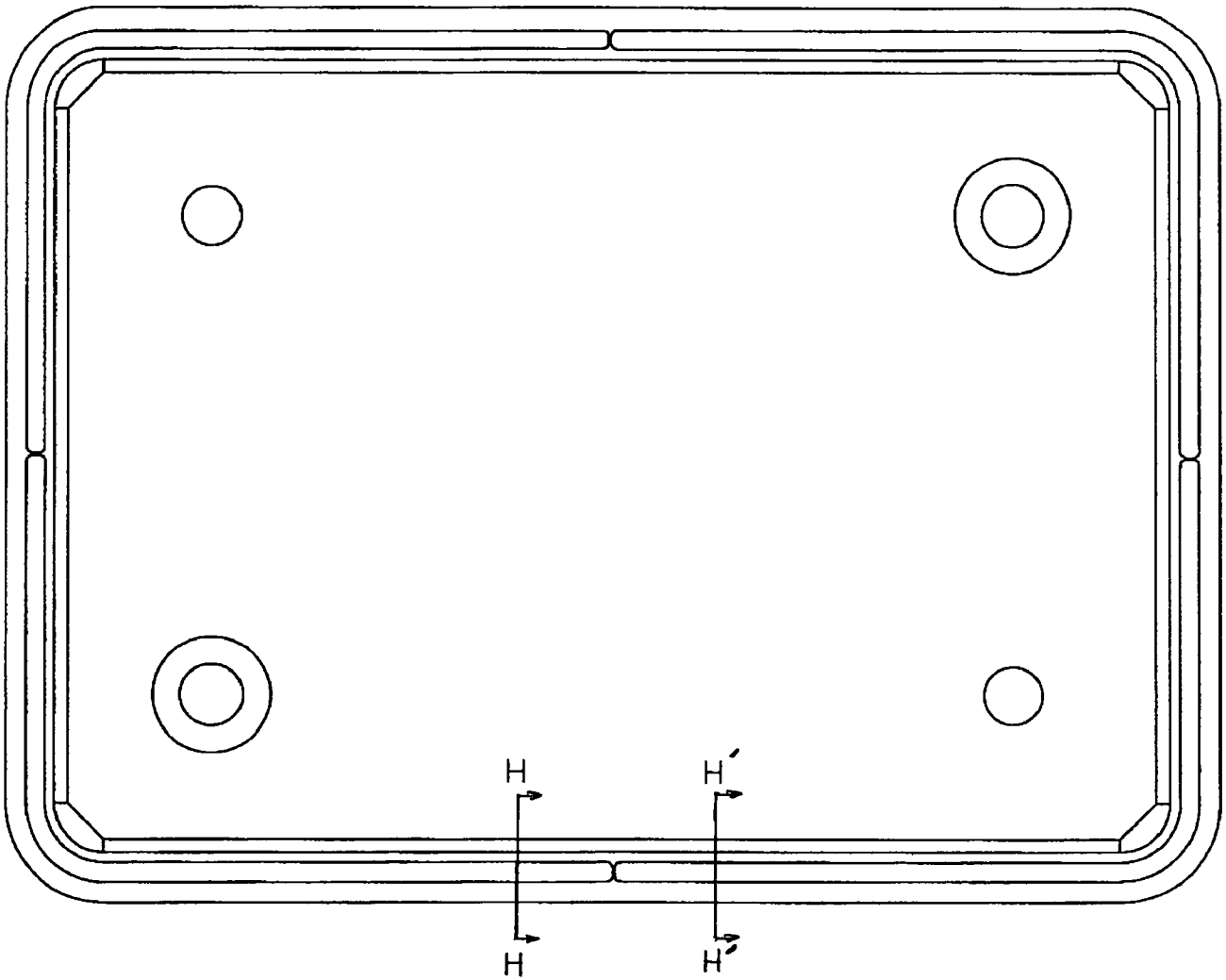
FIG. 13 is a plan view of the container of FIG. 12.
Figure 14:
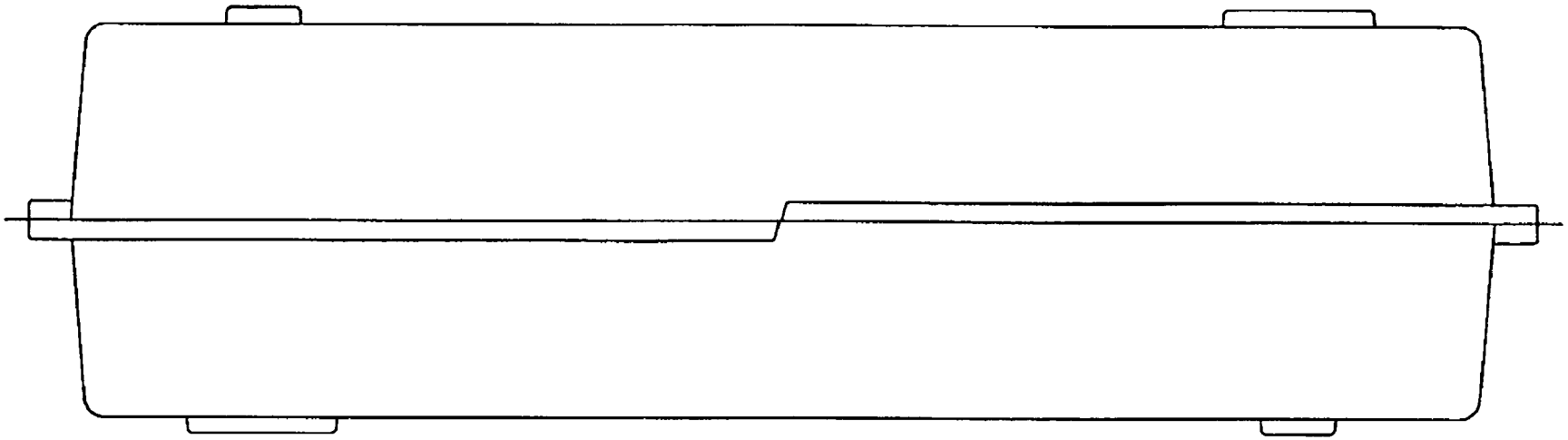
FIG. 14 is a front elevation view of the container of FIG. 13.
Figure 15:
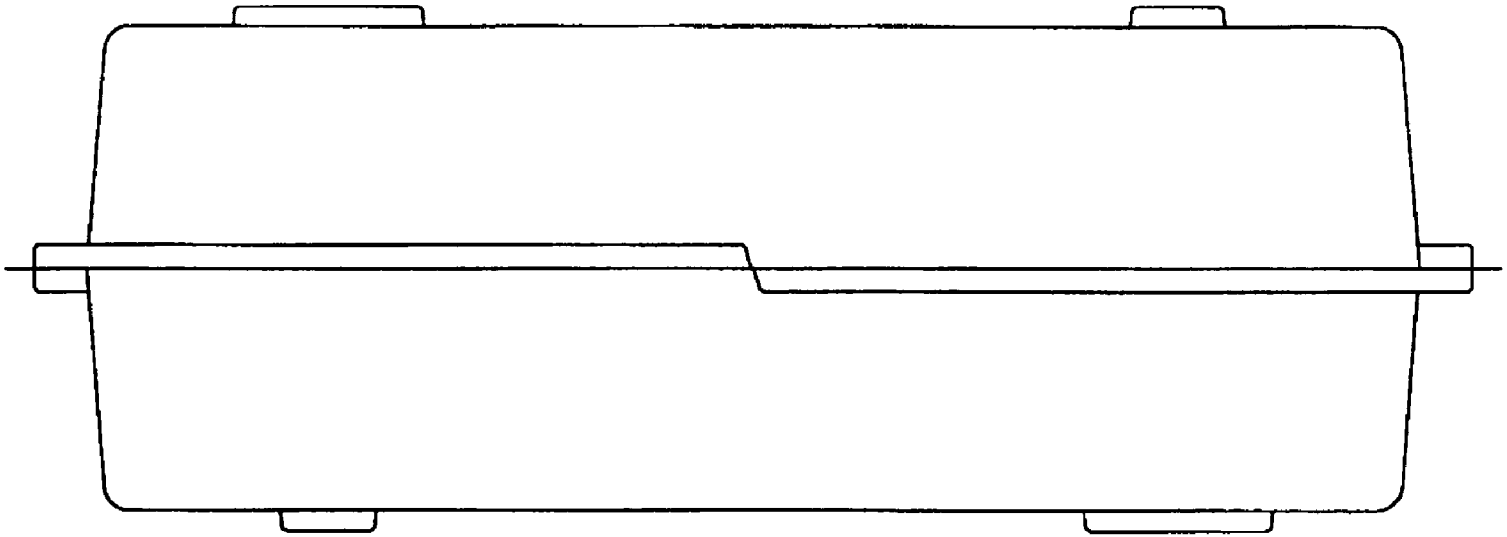
FIG. 15 is a right side elevation view of the container of FIG. 13.
Figures 16, 16A:
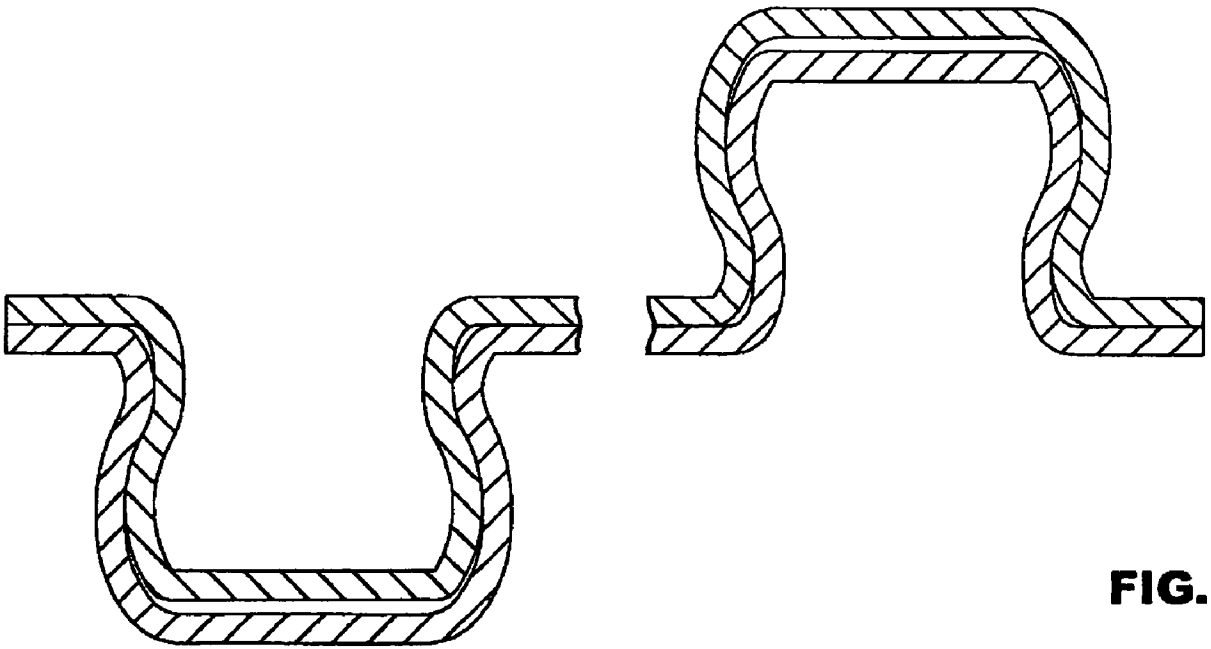
FIG. 16 is an enlarged section view taken on line H-H of FIG. 13.
FIG. 16A is an enlarged sectional view taken on line H-H of FIG. 13.

FIGS. 11-16 show another container 150 of the invention, wherein the container has a smaller width and length, so for the same plastic sheet material (of 0.015 inch thickness) towers and corrugations are not required. FIG. 11 shows that the container includes two identical container elements 152, 154. It can be seen that flange 156 of the lower element 152 has two upward projection sections 160, 162 and has two upwardly-opening groove sections 164, 166. Each projection or groove extends along half of two side walls, by each extending along an angle P of 90° about the container axis 168. As with the container element of FIG. 1, the container element 152 has complementary halves on opposite sides of a vertical plane 170, and the first element can be converted to the second element by pivoting the first element by 180° about a longitudinally-extending M axis 172. The container element is also complementary about an imaginary plane 174 that is perpendicular to plane 170, and the upper element 154 also can be obtained by pivoting the lower element 180° about a lateral axis 176.

The upper container element 154 of FIG. 11 shows alignment features for aligning a pair of closed containers. The alignment features include a pair of upward projections 180 and a pair of protuberances 182 that form a pair of downward recesses 184 that each can closely receive a projection.

Figure 17:
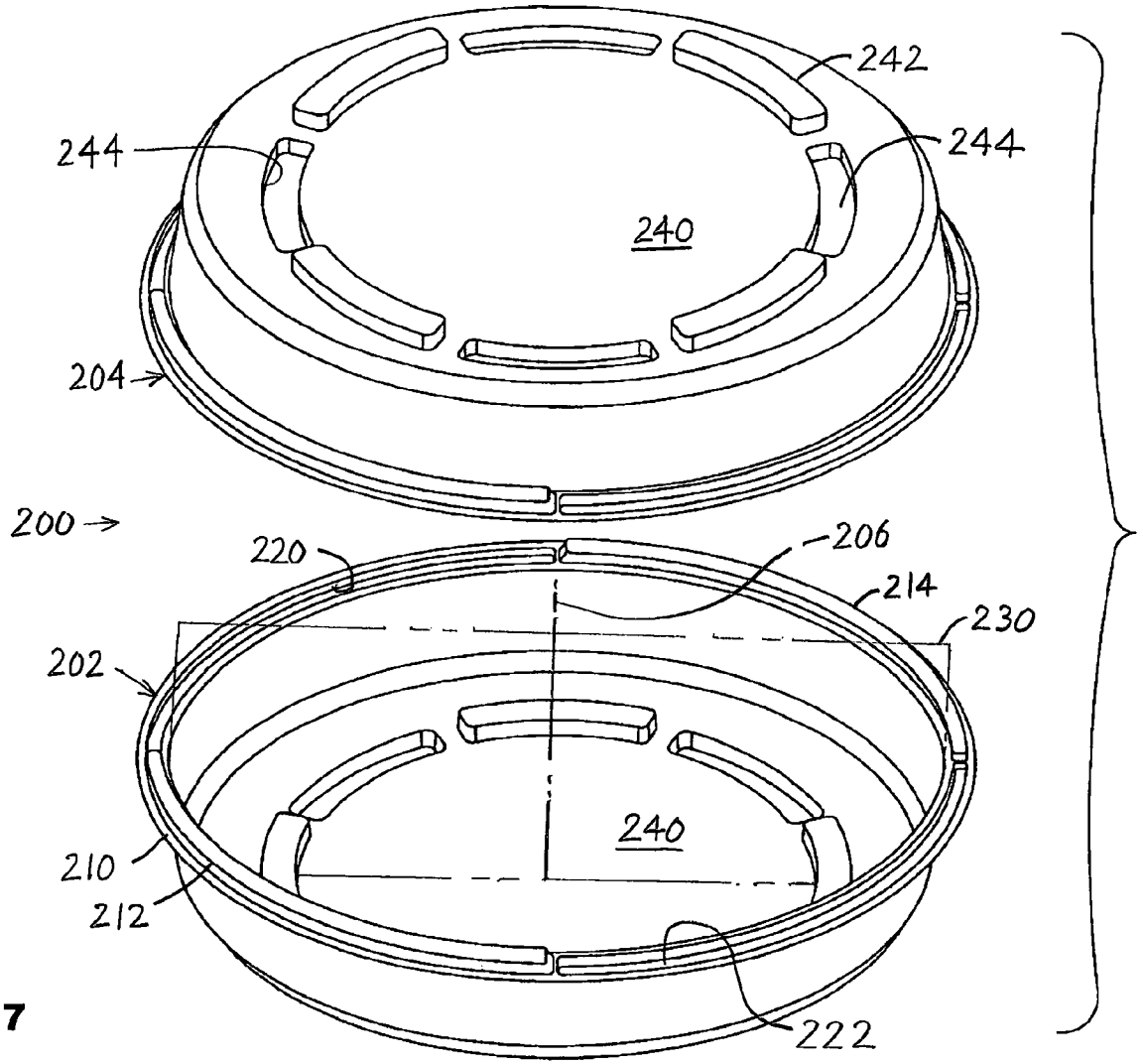
FIG. 17 is an exploded isometric view of a container of another embodiment of the invention.
Figure 18:
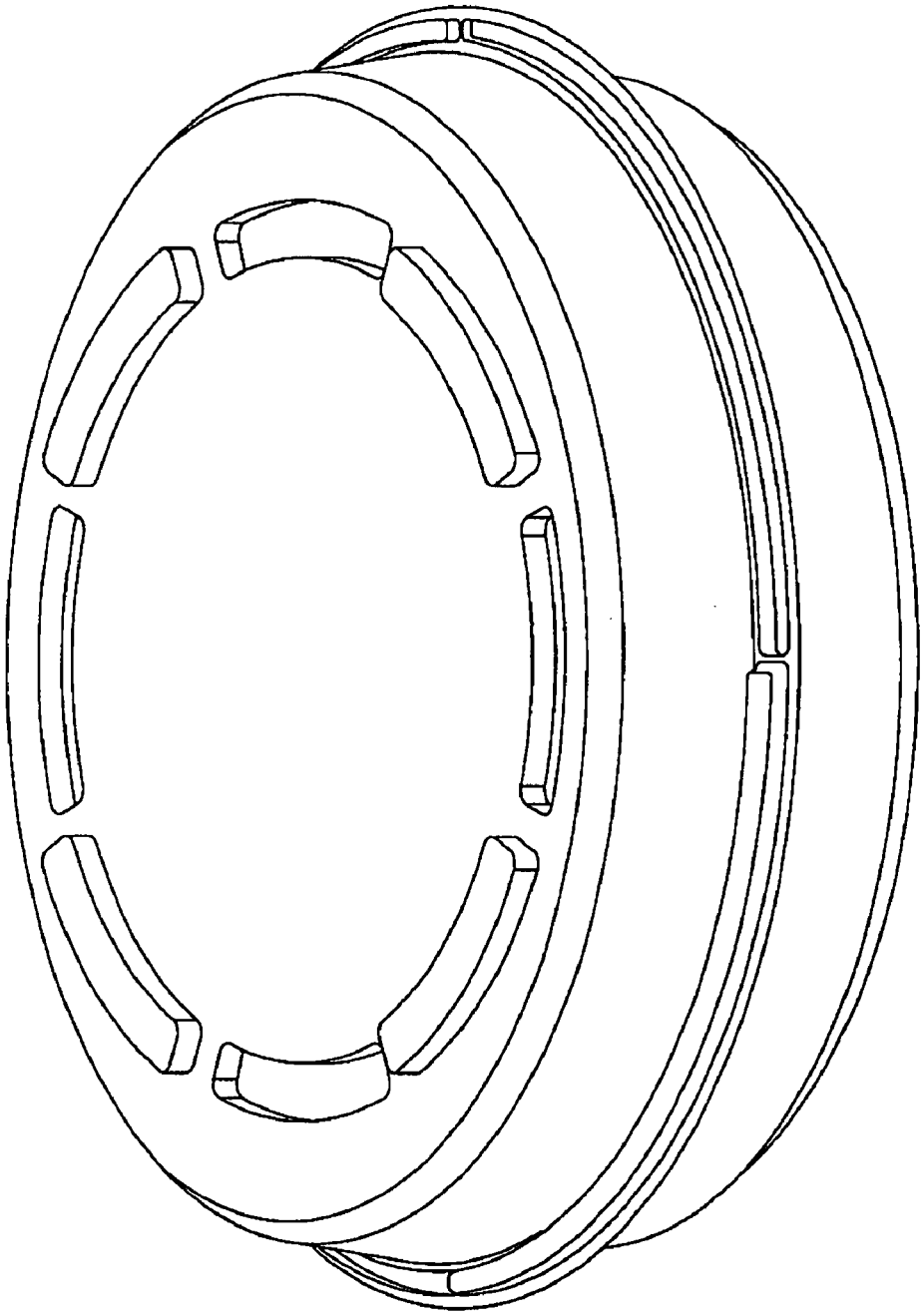
FIG. 18 is an isometric view of the container of FIG. 17 in a closed condition.
Figure 19:
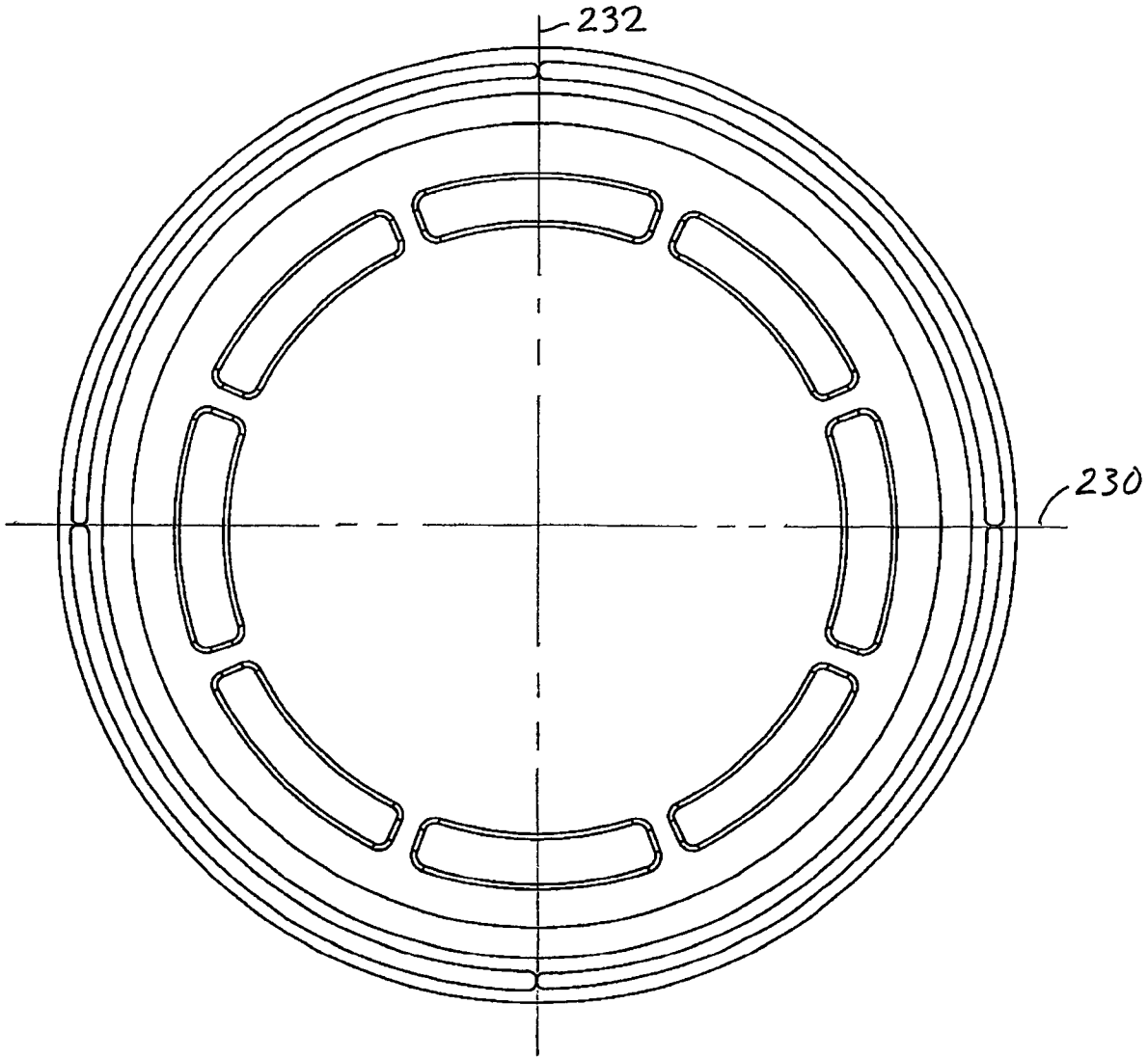
FIG. 19 is a plan view of the container of FIG. 18.
Figure 20:
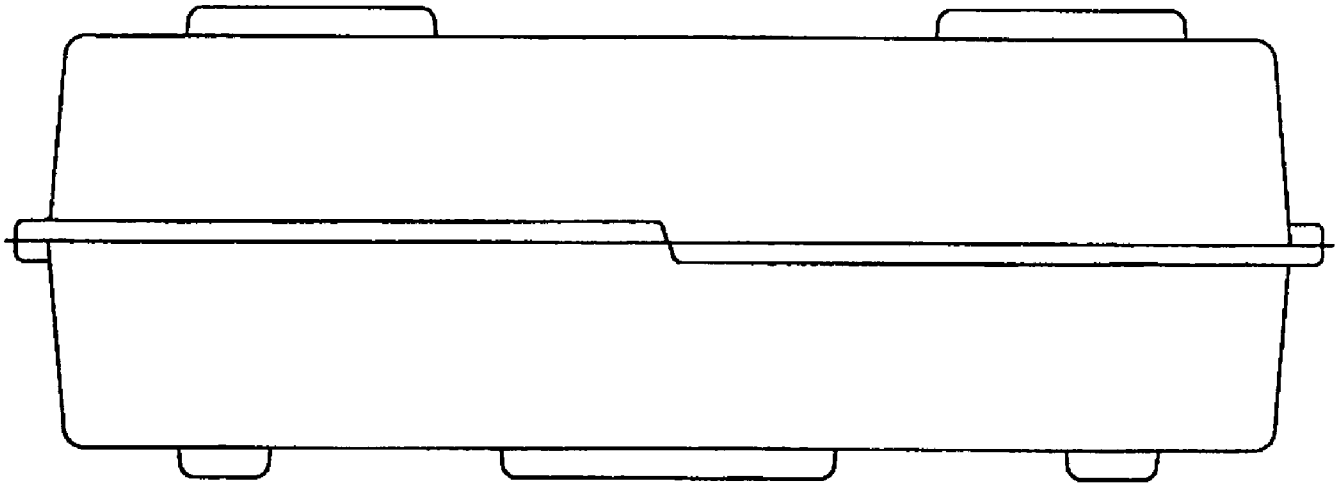
FIG. 20 is a front view of the container of FIG. 18.

FIGS. 17-20 show another container 200 with identical lower and upper container elements 202, 204 that can latch and seal to one another. The container is of round shape as seen in a plan view and has an axis 206. The lower container element 202 has a circular flange 210 with two projection sections 212, 214 where the flange forms upward projections, and with two groove sections 220, 222 where the flange forms upward opening grooves. The projections and grooves are of the same shapes as in the earlier two embodiments of the invention (FIGS. 1-16). The lower container has perpendicular vertical planes 230,232 (FIG. 19) about which the projections and recess are complementary. FIG. 17 also shows that the base wall 240 of the upper container element 204 has upward projections 242 and corresponding upward-opening recesses 244 that are complementary about the two vertical planes 230, 232.

Figure 21:
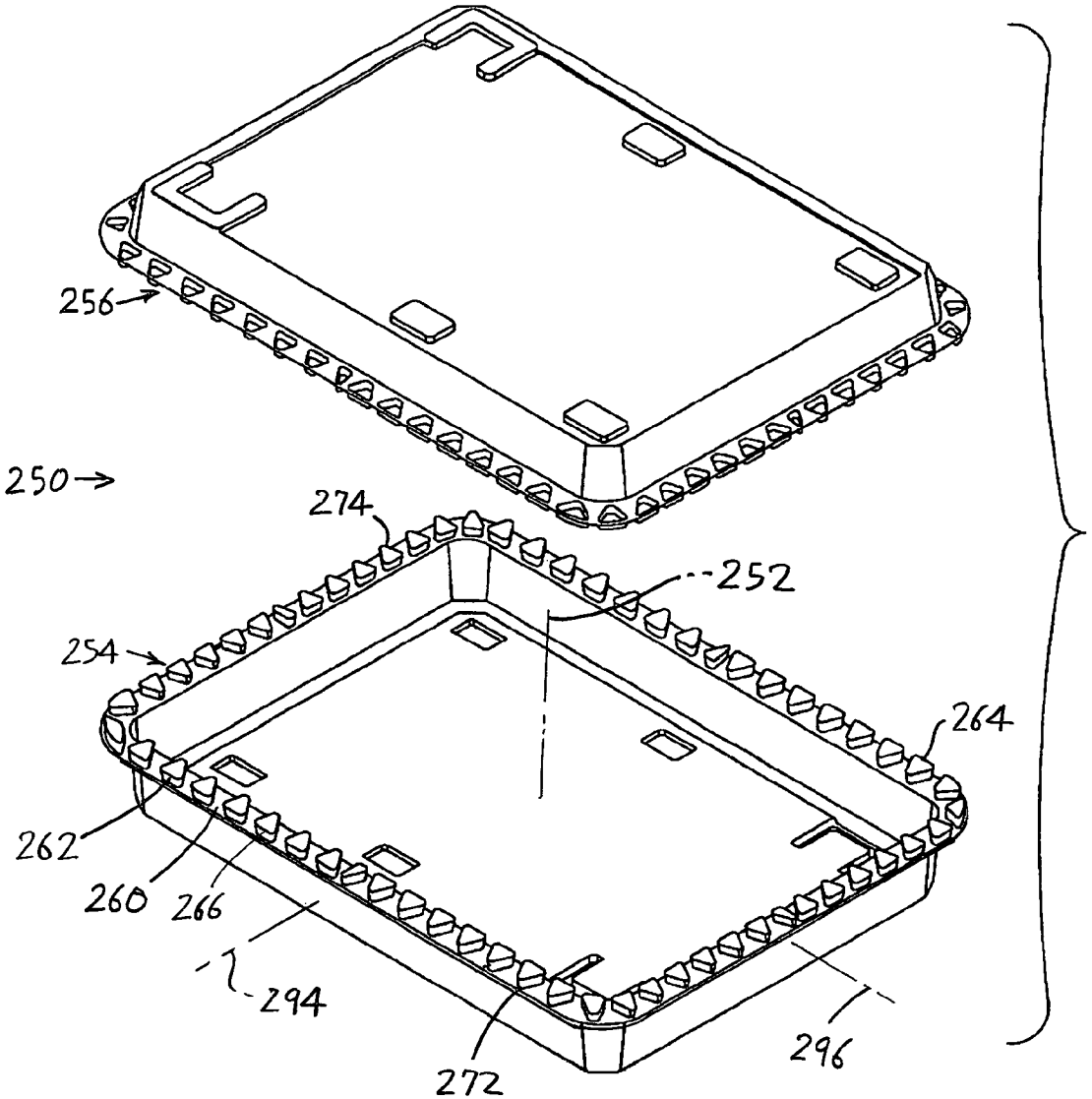
FIG. 21 is an exploded isometric view of a container of another embodiment of the invention.
Figure 22:
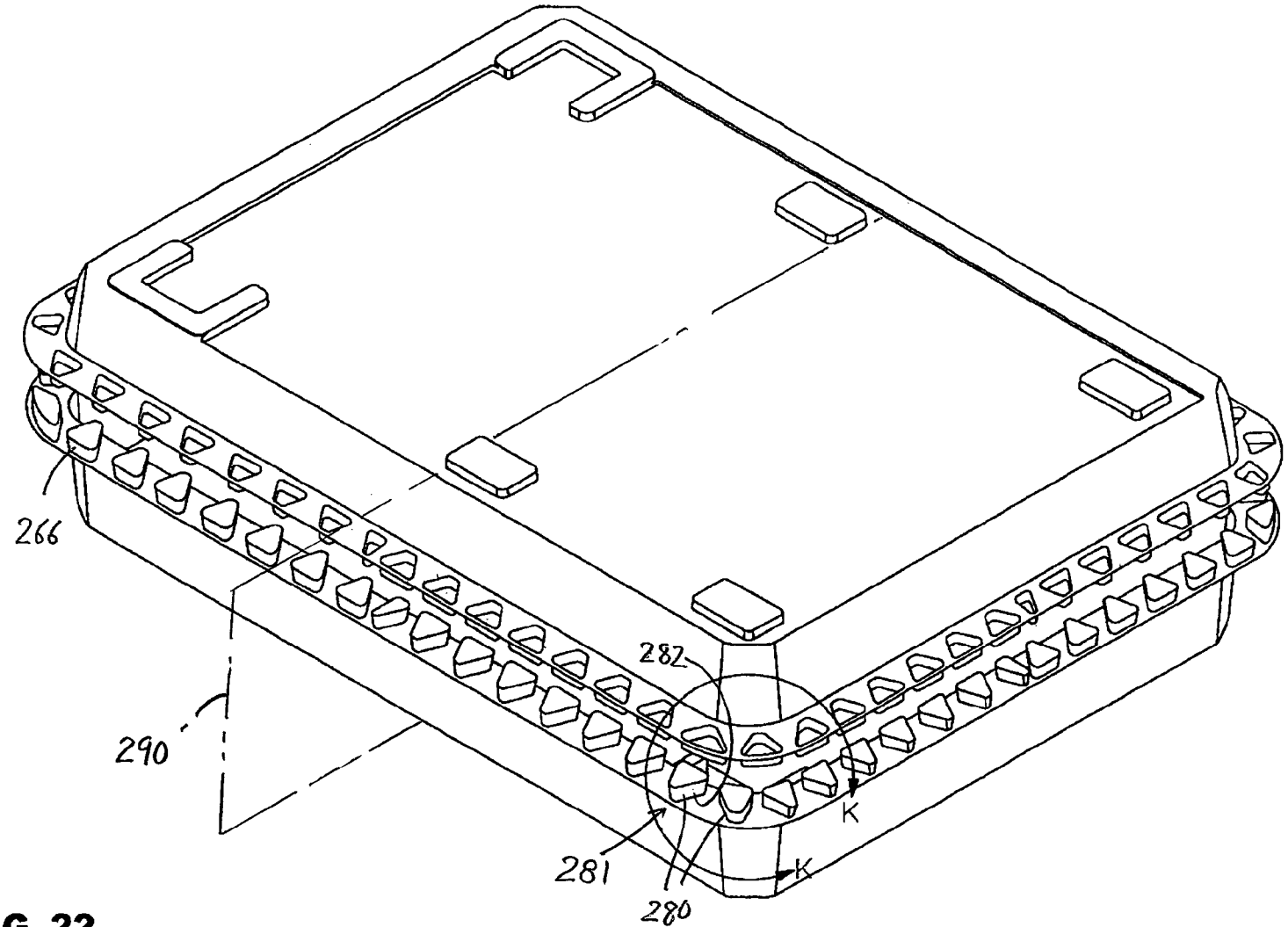
FIG. 22 is an isometric view of a container formed by the container elements of FIG. 21, with the container elements close together but not closed.
Figure 22A:
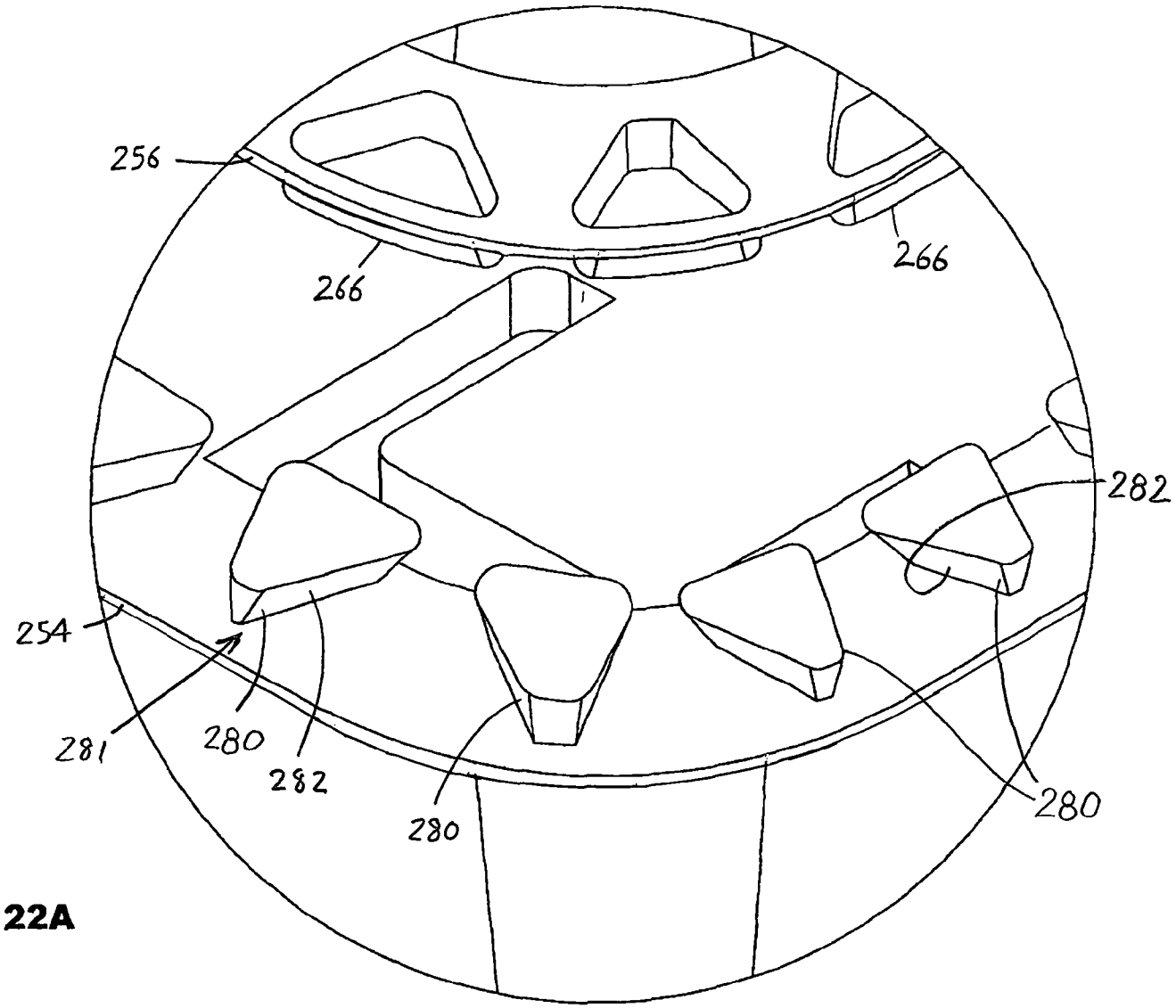
FIG. 22A is an enlarged view of area K-K of FIG. 22.
Figure 23:
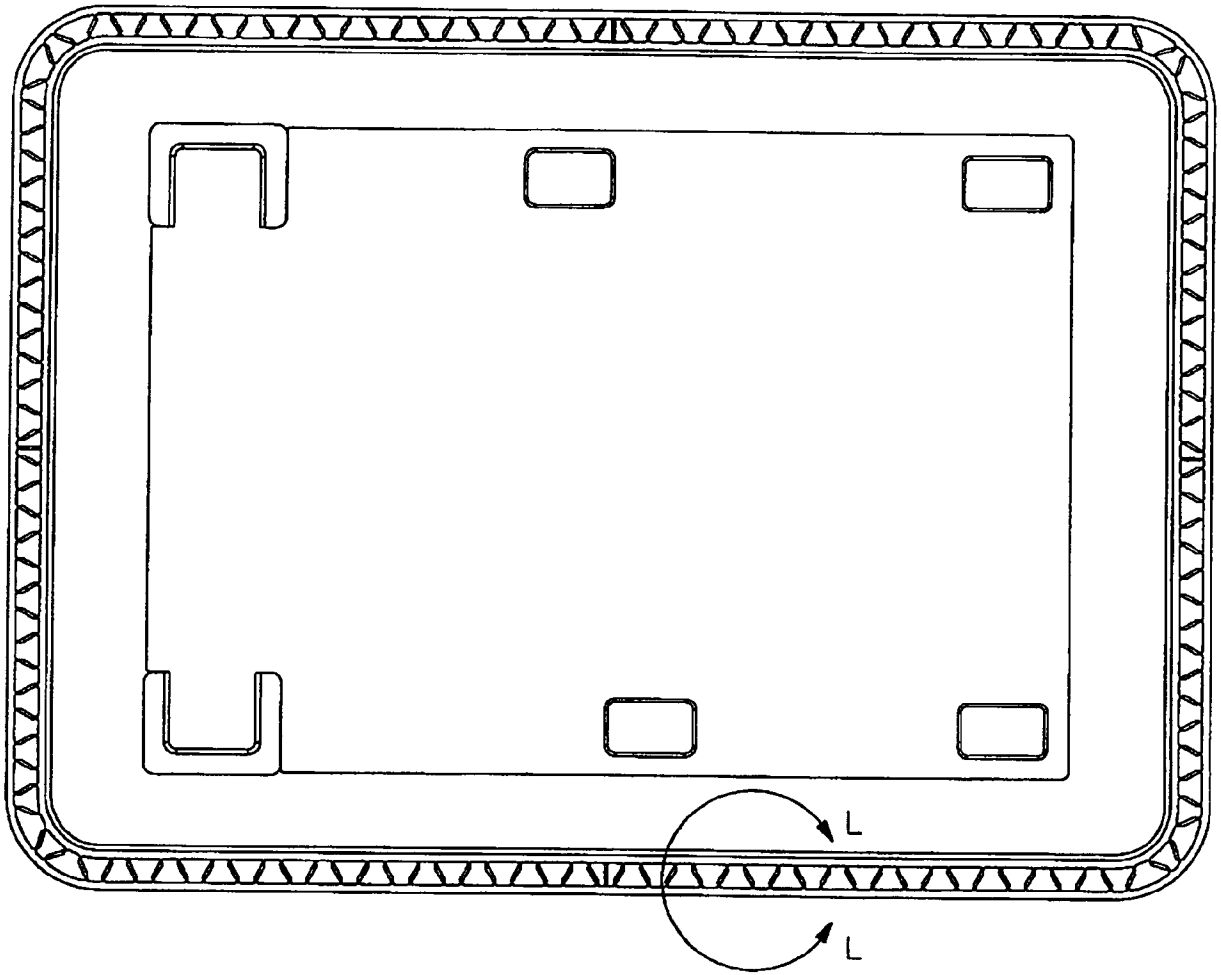
FIG. 23 is a plan view of the container of FIG. 22 in a closed position.
Figure 23A:
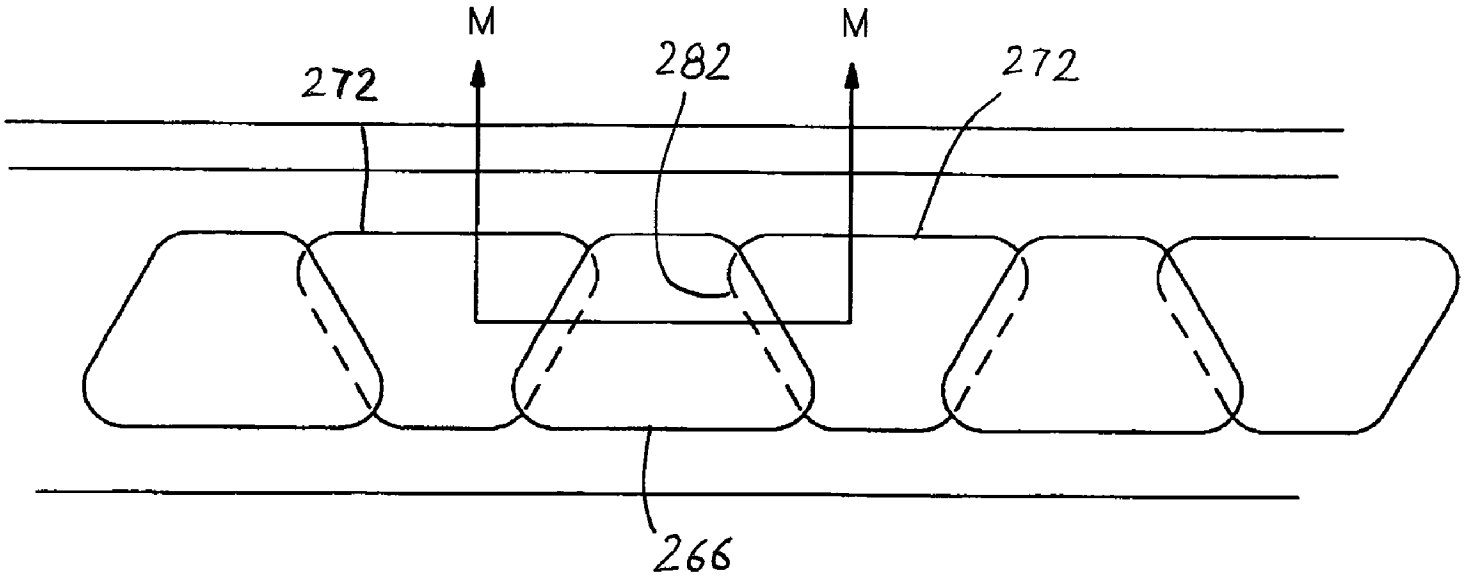
FIG. 23A is an enlarged view of area L-L of FIG. 23.

FIGS. 21-25 illustrate a container 250 that has a vertical axis 252, and that is formed of two identical container elements 254, 256, in accordance with another embodiment of the invention. The lower element 254 has a radially outward-extending flange 260 with multiple upward projections. These include two groups, or sections 262, 264 of outward projections 266 that are widest at their radially outward ends (ends furthest from the axis 252) and two sections 272, 274 of inward projections 274 that are widest at their radially inner ends. FIG. 22A shows the flanges of the lower and upper container elements 254, 256 approaching each other to latch together. Each pair of inward projections 280 on the lower element form a short groove, or an undercut recess or gap 282 between them. A downward and outward projection 266 of the upper container element which is widest at its radially outer end, fits into the recess and locks the upper and lower elements together. FIG. 23A shows that the recess 282 is undercut, so it requires a downward force on the upper element to push its outward projection 266 into the gap between two inward projections 272.

Figure 24:
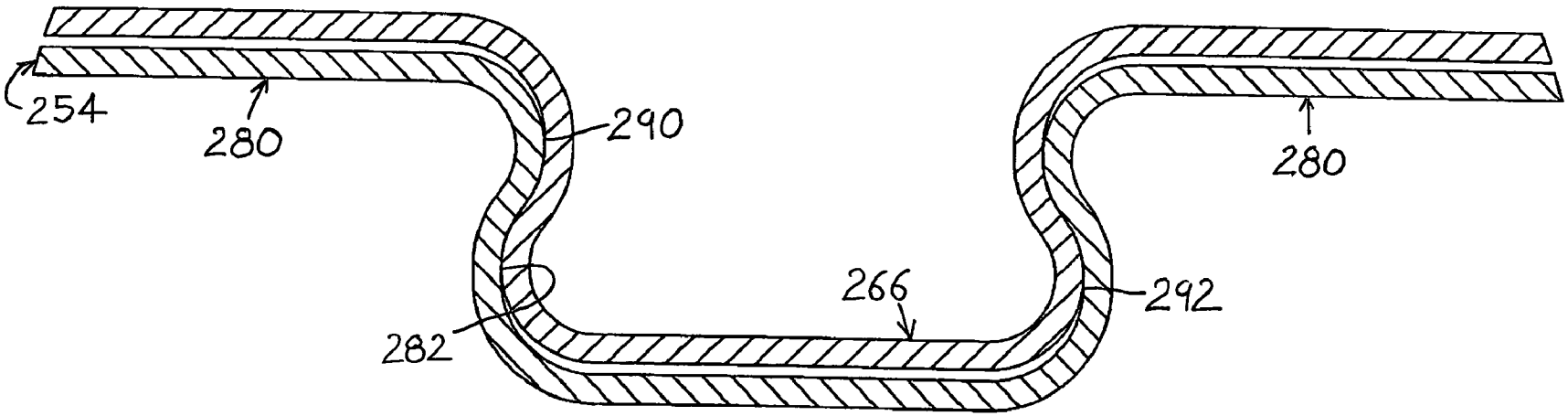
FIG. 24 is an enlarged view of area M-M of FIG. 23A.
Figure 25:
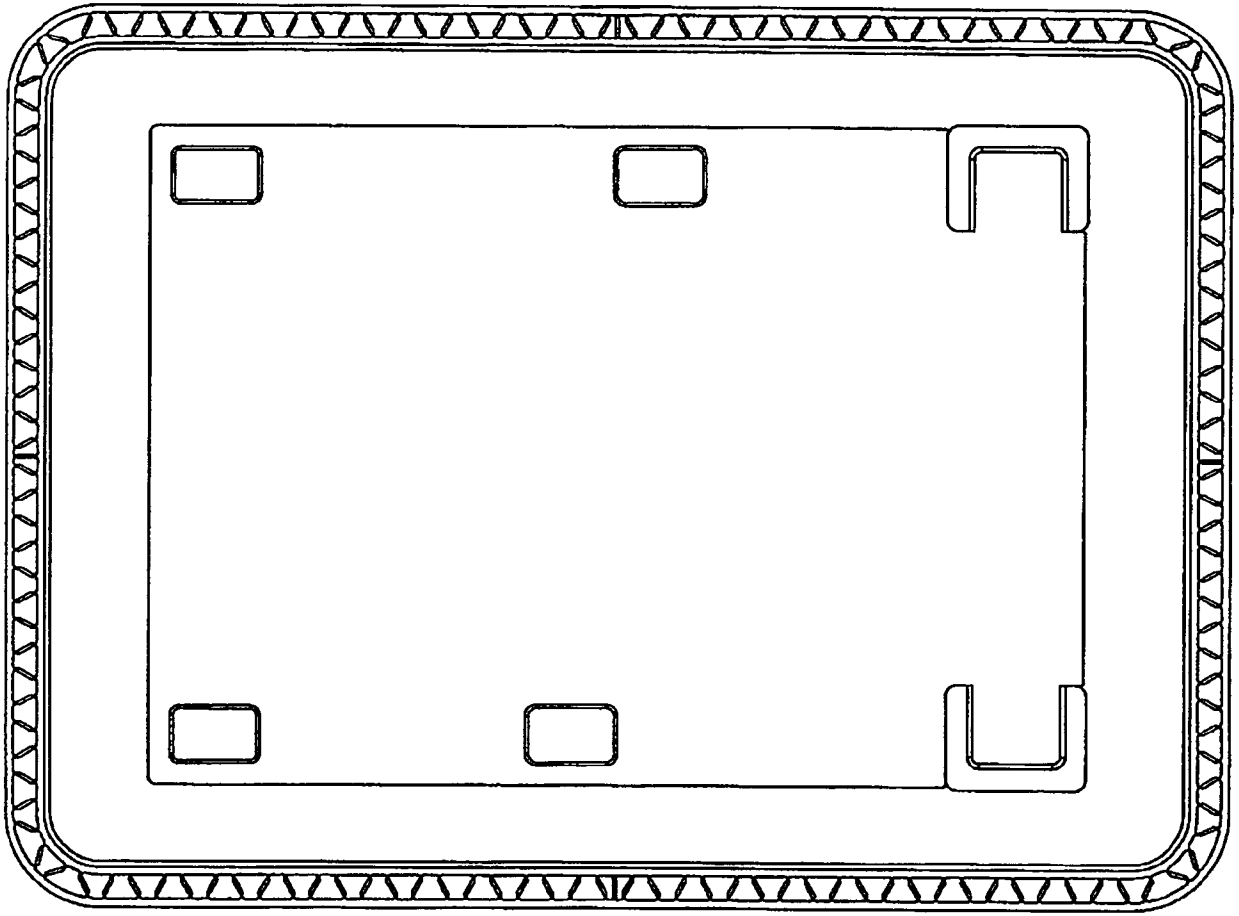
FIG. 25 is a bottom view of the container of FIG. 23.

FIG. 24 shows that each upward and inward projection 280 of the lower container 254 element has an enlarged top 290. A pair of adjacent such projections 280 forms an undercut recess or groove 282 between them. Similarly, each downward and outward projection 266 has an enlarged bottom 292 that lies in the undercut groove 282.

FIG. 21 shows that the lower section 254 can be converted to the upper one by pivoting about either of two horizontal axes 294, 296. In FIG. 22A, two adjacent upward projections such as 280 form a latch part that includes a recess 282, and one downward projection 266 forms a latch part that snaps into the recess. FIG. 22 shows that these two parts 281, 266 lie complementary on opposite sides of a center plane 290.

Thus, the invention provides a container formed of two identical container elements where one element can be pivoted 180° and pushed down to close the top of the other element. If the elements have bases of circular, square, rectangular hexagonal, etc. shape, then they can be constructed so an element is turned about its vertical axis, after being pivoted 180° (turned upside-down), to latch to the other element. The lower element has a flange that is deformed to form at least one section with an upward projection(s) and at least one section with an upwardly-opening groove. Complementary sections lie at equal distances from (perpendicular to) an imaginary vertical plane, so a projection of one element fits into a groove of the other element when the container elements are brought together. The projections and grooves can be of any of a variety of shapes, such as long projections and grooves each in a zig-zag shape or straight shape, or multiple elements spaced along the flange (with each flange section having a single projection or groove). For a large container, middle parts of the bases of stacked containers can be supported on one another by towers. The towers project from the base wall, with undercut projections at the free ends of some towers receiving projections with enlarged heads at the free ends of other towers to prevent towers from sliding off one another. A stack of containers can be stabilized by leaving projections in the base of one container that are received in recesses of another container.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container comprising first and second container elements that each has an axis, a base wall, side walls, and a flange that extends radially away from said axis from upper ends of said side walls when said base wall is lowermost, said container being closeable by placing said second element in an upside-down configuration over said first element, wherein:

said first element has a first section constructed with its flange having at least one upward projection with enlarged top, and with its flange having a second section constructed with its flange forming an upward-opening undercut groove;

said second element lying in said upside-down configuration over said first element, with said flange of said second element having a second section forming a downwardly-opening undercut groove that receives said upward projection of said first section of said first element, and with the flange of said second element having a first section forming a downward projection with enlarged bottom that lies in said groove of said second section of said first element;

said first and second elements are identical with their flanges being sheets wherein each projection on one face of the flange forms a groove in the opposite face of the flange, each projection and the corresponding groove extending in a zig-zag path along a length of one of said flanges.

2. The container of claim 1 wherein the zig-zag path extends at an angle between 10 degrees and 45 degrees.

3. A container comprising first and second container elements that each has an axis, a base wall, side walls, and a flange that extends radially away from said axis from upper ends of said side walls when said base wall is lowermost, said container being closeable by placing said second element in an upside-down configuration over said first element, wherein:

said first element has a first section constructed with its flange having at least one upward projection with enlarged top, and with its flange having a second section constructed with its flange forming an upward-opening undercut groove;

said second element lying in said upside-down configuration over said first element, with said flange of said second element having a second section forming a downwardly-opening groove that receives said upward projection of said first section of said first element, and with the flange of said second element having a first section forming a downward projection with enlarged bottom that lies in said groove of said second section of said first element;

said first and second elements are identical with their flanges being sheets wherein each projection on one face of the flange forms a groove in the opposite face of the flange, said elements each has left and right halves with the base wall in the left half of each element when the element is oriented with its base wall lowermost, having at least one downward projection, and the base wall in the right half of each element having at least one large downward protuberance with a smaller upward opening depression therein that closely receives said downward projection of another identical element that is in an upside-down orientation.

4. A container assembly comprising:

a first container including a base wall, a plurality of side walls, and a flange that encompasses and extends outwardly from said side walls, the first container having a first section and a second section, the first section having said flange forming at least one first projection, said second section having said flange forming a first undercut groove, each of said at least one first projection and said first undercut groove forming a zig-zag path along at least a portion of the length of said flange; and a second container including a second base wall, a plurality of second side walls, and a second flange that encompasses and extends outwardly from said second side walls, the second container having a third section and a fourth section, the third section having said second flange forming at least one second projection, said fourth section having said second flange forming a second undercut groove, each of said at least one second projection and said second undercut groove forming a zig-zag path along at least a portion of the length of said second flange;

wherein said second container and first container form a container assembly when said second container is inverted and placed over the first container in which said second groove of said second container receives said first projection of said first container and said first groove of said first container receives said second projection of said second container.

5. The container assembly of claim 4 wherein the zig-zag path extends at an angle between 10 degrees and 45 degrees.

6. A container assembly comprising:

a first container including a base wall, a plurality of side walls, and a flange that encompasses and extends outwardly from said side walls, the first container having a first section and a second section, the first section having said flange forming at least one first projection, said second section having said flange forming a first undercut groove, said base wall including a first tower and a second tower extending therefrom, said first tower including an enlarged top, said second tower including a tip forming an undercut tower recess; and a second container including a second base wall, a plurality of second side walls, and a second flange that encompasses and extends outwardly from said second side walls, the second container having a third section and a fourth section, the third section having said second flange forming at least one second projection, said fourth section having said second flange forming a second undercut groove, said second base wall including a third tower and a fourth tower extending therefrom, said third tower including an enlarged top, said fourth tower including a tip forming a second undercut tower recess;

wherein said second container and said first container form said container assembly when said second container is inverted and placed over the first container in which said second undercut groove of said second container receives said first projection of said first container and said first undercut groove of said first container receives said second projection of said second container;

wherein said first tower is adapted to engage and snap into said fourth tower and said third tower is adapted to engage and snap into second tower when said second container and said first container form said container assembly.

7. The container assembly of claim 6 wherein each of said at least one first projection and said first undercut groove forms a zig-zag path along at least a portion of the length of said flange and wherein each of said at least one second projection and said second undercut groove forms a zig-zag path along at least a portion of the length of said second flange.

8. The container assembly of claim 7 wherein the zig-zag path extends at an angle between 10 degrees and 45 degrees.

* * * * *